US012668385B2

(12) United States Patent
Kasahara et al.

(10) Patent No.: US 12,668,385 B2
(45) Date of Patent: Jun. 30, 2026

(54) BINDING MACHINE AND BINDING DEVICE

(71) Applicant: MAX CO., LTD., Tokyo (JP)

(72) Inventors: Akira Kasahara, Tokyo (JP); Kenichi Arai, Tokyo (JP)

(73) Assignee: Max Co., Ltd., Tokyo (JP)

( * ) Notice: Subject to any disclaimer, the term of this patent is extended or adjusted under 35 U.S.C. 154(b) by 266 days.

(21) Appl. No.: 18/198,594

(22) Filed: May 17, 2023

(65) Prior Publication Data

US 2023/0382577 A1 Nov. 30, 2023

(30) Foreign Application Priority Data

May 30, 2022 (JP) ..... 2022-087302

(51) Int. Cl.
*B65B 13/02* (2006.01)

(52) U.S. Cl.
CPC ..... *B65B 13/025* (2013.01)

(58) Field of Classification Search
CPC ... B65B 13/025; E04G 21/122; E04G 21/123; B21F 15/02
See application file for complete search history.

(56) References Cited

U.S. PATENT DOCUMENTS 5,826,629 A 10/1998 West
2009/0283170 A1* 11/2009 Nagaoka ..... B25B 25/00 140/119
2010/0147411 A1 6/2010 Kusakari et al.
2014/0246114 A1 9/2014 Kusakari et al.
2015/0267423 A1 9/2015 Kusakari et al.
2016/0222683 A1 8/2016 Kusakari et al.
2018/0363309 A1 12/2018 Kusakari et al.
2019/0194958 A1 6/2019 Machida et al.
2020/0002962 A1 1/2020 Kawazoe
2022/0034109 A1* 2/2022 Morimura ..... E04G 21/123
2022/0106067 A1 4/2022 Hamano et al.
2023/0118858 A1* 4/2023 Itagaki ..... B65B 13/025 53/399

FOREIGN PATENT DOCUMENTS

EP 2123403 A1 11/2009
EP 3945180 A1 2/2022
JP S55-021982 U 2/1980
(Continued)

OTHER PUBLICATIONS

Oct. 27, 2023—(EP) Search Report—EP App 23175477.1.
Feb. 21, 2024—(EP) Extended Search Report—App 23175477.1.

*Primary Examiner* — Debra M Sullivan
(74) *Attorney, Agent, or Firm* — Banner & Witcoff, Ltd.

(57) ABSTRACT

There is provided a binding machine, including: a wire feeding portion configured to feed a wire; a guide portion constituting a part of a path through which the wire fed by the wire feeding portion is to pass; a displacement portion configured to move the guide portion between a first position constituting the path and a second position retracted from the path; a driving portion configured to drive the displacement portion; and an accumulation suppressing portion configured to suppress a foreign object from accumulating in a region formed along a moving direction of the displacement portion that is configured to move between the first position and the second position.

8 Claims, 28 Drawing Sheets

(56) References Cited

FOREIGN PATENT DOCUMENTS

| | | | |
|---|---|---|---|
| JP | 2006-036251 | A | 2/2006 |
| JP | 2009-275487 | A | 11/2009 |
| JP | 5045547 | B2 | 10/2012 |
| JP | 5182212 | B2 | 4/2013 |
| JP | 2020-001816 | A | 1/2020 |
| JP | 2020-084428 | A | 6/2020 |
| JP | 2021-021272 | A | 2/2021 |
| JP | 2022-060851 | A | 4/2022 |

* cited by examiner

BINDING MACHINE AND BINDING DEVICE

CROSS-REFERENCE TO RELATED APPLICATIONS

This application is based on Japanese Patent Application No. 2022-087302 filed on May 30, 2022, the contents of which are incorporated herein by way of reference.

TECHNICAL FIELD

The present invention relates to a binding machine that binds objects to be bound such as reinforcing bars with a wire, and a binding device including the binding machine.

BACKGROUND ART

Reinforcing bars are used for a concrete structure in order to improve strength, and the reinforcing bars are bounded by a wire such that the reinforcing bars do not deviate from a predetermined position during concrete placement.

In the related art, there has been proposed a binding machine referred to as a reinforcing bar binding machine that winds a wire around two or more reinforcing bars and twists the wire wound around the reinforcing bars to bind the two or more reinforcing bars with the wire. In such a reinforcing bar binding machine, a technique has been proposed in which a partition plate is disposed between feeding gears and a wire feeding motor, and a discharging portion for discharging wire dust is provided on an outer peripheral portion of an upper surface of the partition plate (for example, see Patent Literature 1). There has been proposed a technique in which a cover portion for closing a gap of a lower curl guide base portion is formed (for example, see Patent Literature 2).

Patent Literature 1: JP5045547B

Patent Literature 2: JP5182212B

In the reinforcing bar binding machine described in Patent Literature 1, it is impossible to deal with foreign objects that enter from a path through which a wire guided by a guide portion passes, and foreign objects generated in the path through which the wire guided by the guide portion passes. In the reinforcing bar binding machine described in Patent Literature 2, it is impossible to deal with foreign objects that enter into a region in which the lower curl guide is moved, and foreign objects generated in the region in which the lower curl guide is moved.

The present invention has been made to solve such problems, and an object of the present invention is to provide a binding machine capable of dealing with foreign objects which are factors for suppressing movement of a guide portion for guiding a wire, and a binding device including the binding machine.

SUMMARY OF INVENTION

There is provided a binding machine, including: a wire feeding portion configured to feed a wire; a guide portion constituting a part of a path through which the wire fed by the wire feeding portion is to pass; a displacement portion configured to move the guide portion between a first position constituting the path and a second position retracted from the path; a driving portion configured to drive the displacement portion; and an accumulation suppressing portion configured to suppress a foreign object from accumulating in a region formed along a moving direction of the displacement portion that is configured to move between the first position and the second position.

There is provided a binding machine, including: a wire feeding portion configured to feed a wire; a guide portion constituting a part of a path through which the wire fed by the wire feeding portion is to pass; a displacement portion configured to move the guide portion between a first position constituting the path and a second position retracted from the path; a driving portion configured to drive the displacement portion; and an entry suppressing portion configured to suppress a foreign object from entering into a region formed along a moving direction of the displacement portion that is configured to move between the first position and the second position.

There is provided a binding device, including: a binding machine configured to bind an object to be bound with a wire. The binding machine includes a wire feeding portion configured to feed the wire, a guide portion constituting a part of a path through which the wire fed by the wire feeding portion is to pass, a displacement portion configured to move the guide portion between a first position constituting the path and a second position retracted from the path, a driving portion configured to drive the displacement portion, and an accumulation suppressing portion configured to suppress a foreign object from accumulating in a region formed along a moving direction of the displacement portion that is configured to move between the first position and the second position.

There is provided a binding device, including: a binding machine configured to bind an object to be bound with a wire. The binding machine includes a wire feeding portion configured to feed the wire, a guide portion constituting a part of a path through which the wire fed by the wire feeding portion is to pass, a displacement portion configured to move the guide portion between a first position constituting the path and a second position retracted from the path, a driving portion configured to drive the displacement portion, and an entry suppressing portion configured to suppress a foreign object from entering into a region formed along a moving direction of the displacement portion that is configured to move between the first position and the second position.

DESCRIPTION OF EMBODIMENTS

Hereinafter, an embodiment of a reinforcing bar binding machine, which is an example of a binding machine according to the present invention, and an embodiment of a binding device in which the binding machine is used will be described with reference to the drawings.

<Configuration Example of Reinforcing Bar Binding Machine>

Figure 1A:
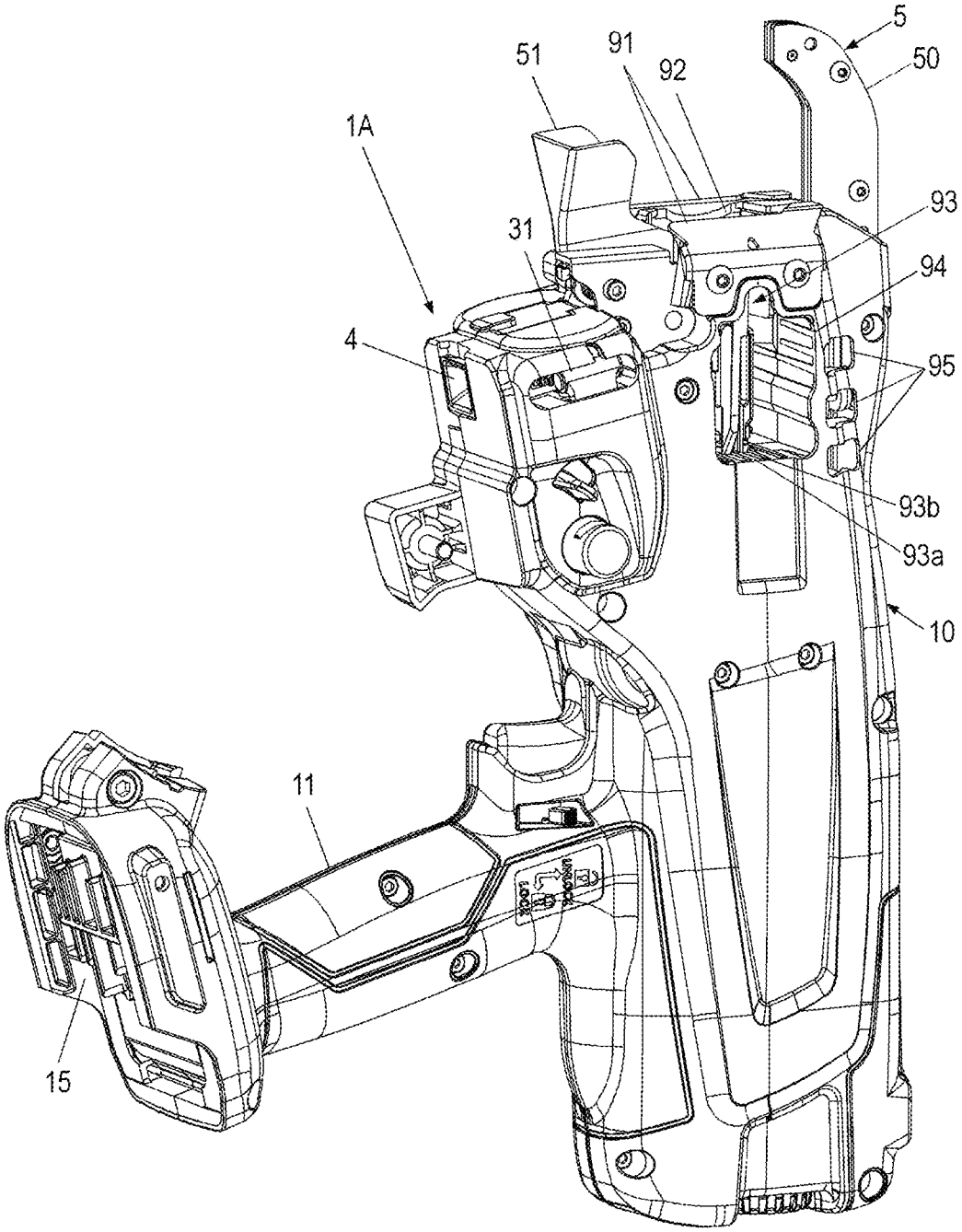
FIG. 1A is a perspective view illustrating an example of a reinforcing bar binding machine according to the present embodiment.
Figure 1B:
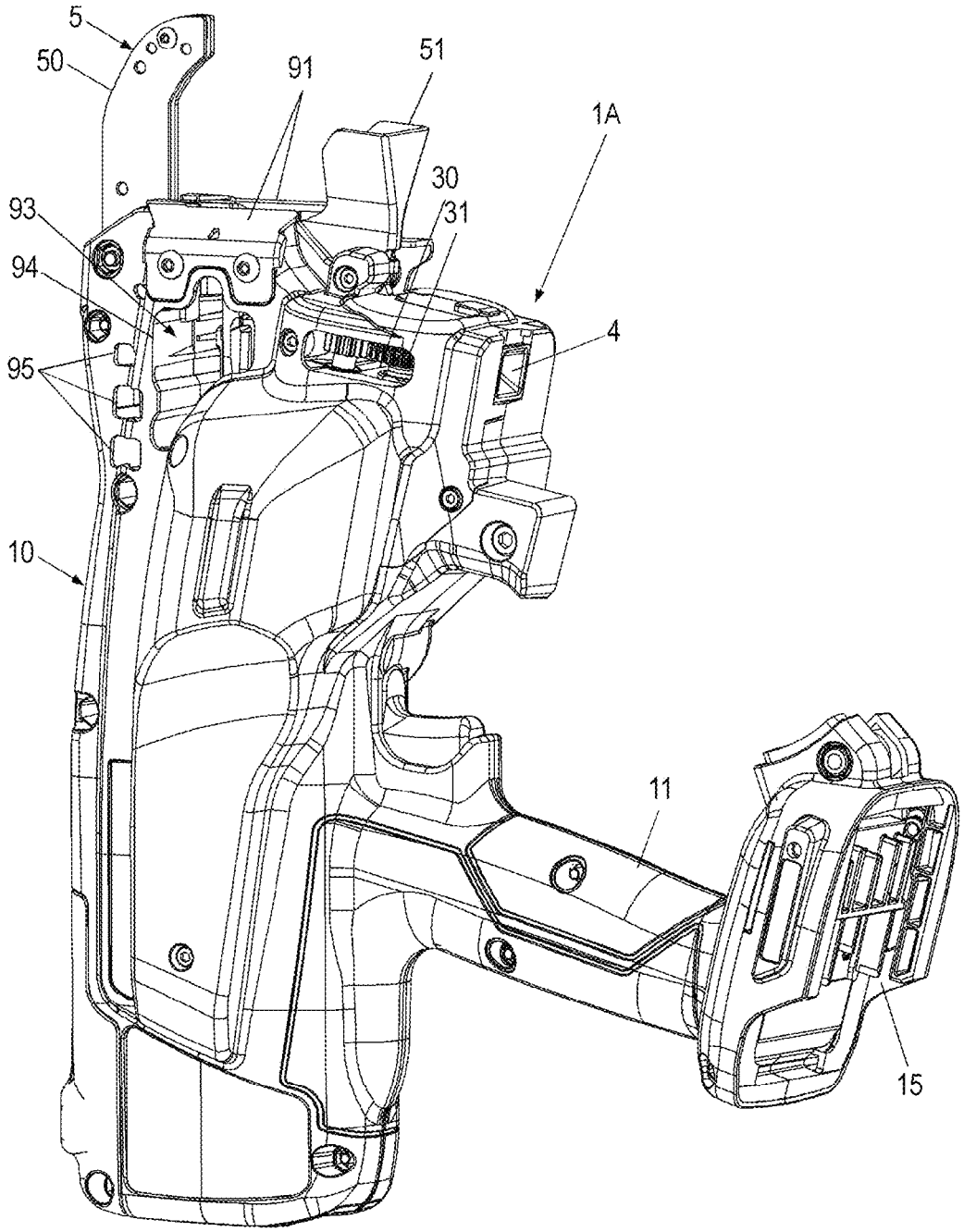
FIG. 1B is a perspective view illustrating the example of the reinforcing bar binding machine according to the present embodiment.
Figure 2:
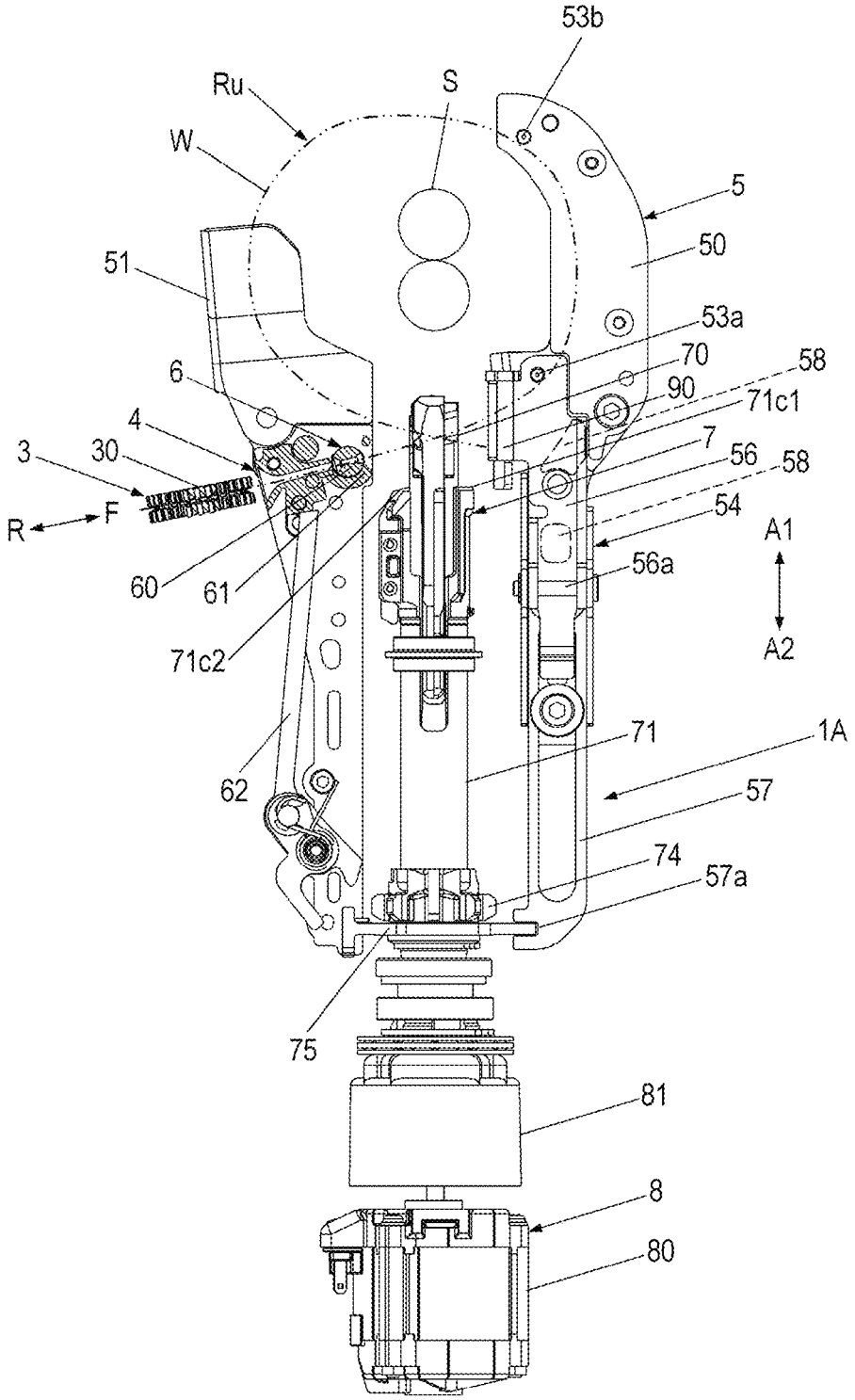
FIG. 2 is a main portion side view illustrating an example of an internal configuration of the reinforcing bar binding machine according to the present embodiment.

FIGS. 1A and 1B are perspective views each illustrating an example of the reinforcing bar binding machine according to the present embodiment, and FIG. 2 is a main portion side view illustrating an example of an internal configuration of the reinforcing bar binding machine according to the present embodiment.

A reinforcing bar binding machine 1A is an example of the binding machine, and as illustrated in FIG. 2, the reinforcing bar binding machine 1A feeds a wire W in a forward direction indicated by an arrow F, winds the wire W around two intersecting reinforcing bars S serving as objects to be bound, feeds the wire W wound around the reinforcing bars S in a reverse direction indicated by an arrow R, winds the wire W with the reinforcing bars S, and then twists the wire W to bind the reinforcing bars S with the wire W. Examples of the wire W include a wire formed of a metal wire capable of being plastically deformed, a wire obtained by coating a metal wire with a resin, and a stranded wire.

In order to implement the above functions, the reinforcing bar binding machine 1A includes a wire feeding portion 3 that feeds the wire W in the forward direction and the reverse direction, and wire guides 4 that guide the wire W fed to the wire feeding portion 3. The reinforcing bar binding machine 1A includes a curl forming portion 5 that constitutes a path for winding the wire W fed by the wire feeding portion 3 around the reinforcing bars S, and a cutting portion 6 that cuts the wire W wound with the reinforcing bars S. Further, the reinforcing bar binding machine 1A includes a binding portion 7 that twists the wire W wound with the reinforcing bars S, and a driving portion 8 that drives the binding portion 7.

In the reinforcing bar binding machine 1A, the wire feeding portion 3, the wire guides 4, the cutting portion 6, the binding portion 7, and the driving portion 8 are provided inside a main body portion 10 covered with an exterior having a predetermined shape. The curl forming portion 5 is provided in a manner of protruding from the main body portion 10. When the reinforcing bar binding machine 1A is used in a binding device to be described later, the reinforcing bar binding machine 1A is used in a form in which the curl forming portion 5 faces upward. Hereinafter, in the reinforcing bar binding machine 1A used in the binding device, a side on which the curl forming portion 5 is provided is referred to as an upper side.

The wire feeding portion 3 includes a pair of feeding gears 30 that sandwich and feed one or a plurality of parallel wires W. In the wire feeding portion 3, the pair of feeding gears 30 are biased in a direction in which the pair of feeding gears 30 approach each other, and a rotational operation of a feeding motor (not illustrated) is transmitted to rotate the feeding gears 30. Accordingly, the wire feeding portion 3 feeds the wire W sandwiched between the pair of feeding gears 30 along an extending direction of the wire W. In a configuration in which a plurality of, for example, two wires W are fed, the two wires W are fed in parallel.

The wire guides 4 are provided at predetermined positions on an upstream side and a downstream side of the wire feeding portion 3 with respect to the forward feeding direction of the wire W indicated by the arrow F. In FIG. 2, the wire guide 4 provided on the upstream side of the wire feeding portion 3 is not illustrated.

The wire guide 4 is provided with an opening extending along the feeding direction of the wire W, and an opening area of the opening on the downstream side is small compared with that of the opening on the upstream side along the forward feeding direction of the wire W. For example, the wire guide 4 is implemented by a tapered opening in which an opening area on an introduction side of the wire W fed in the forward direction is largest and the opening area gradually decreases therefrom. Accordingly, the wire guide 4 guides the wire W, which is fed in the forward direction and passes through the wire guide 4, to between the pair of feeding gears 30 and to the cutting portion 6.

In the configuration in which the reinforcing bar binding machine 1A binds the reinforcing bars S with two wires W, the wire guide 4 is implemented in a manner that an opening, which is on the downstream side in the forward feeding direction of the wire W, has a shape that regulates an orientation of the two wires W in a radial direction. Accordingly, the wire guide 4 arranges the two wires W, which are fed in the forward direction and pass through the wire guide 4, in parallel along a direction in which the pair of feeding gears 30 are arranged, and guides the two wires W to between the pair of feeding gears 30 and to the cutting portion 6.

The curl forming portion 5 includes a curl guide 50 that curls the wire W fed by the wire feeding portion 3, and a leading guide 51 that leads the wire W curled by the curl guide 50 to the binding portion 7. In the curl forming portion 5, the curl guide 50 and the leading guide 51 are provided in a manner of being exposed from the main body portion 10.

In the reinforcing bar binding machine 1A, since a feeding path of the wire W fed by the wire feeding portion 3 is regulated by the curl forming portion 5, a trajectory of the wire W becomes a loop Ru as illustrated by a broken line in FIG. 2, and the wire W is wound around the reinforcing bars S.

The curl forming portion 5 includes a guide member 53*a* and a guide member 53*b* that guide the wire W fed in the forward direction and curl the wire W. The guide member 53*a* is an example of a guide portion, and is provided on an introduction portion side of the wire W fed by the wire feeding portion 3 in the curl guide 50. The guide member 53*a* is disposed on an inner side in the radial direction of the loop Ru formed by the wire W fed by the wire feeding portion 3, and constitutes a part of the path through which the wire W fed by the wire feeding portion 3 passes. The guide member 53*b* is provided on a discharging portion side of the wire W fed by the wire feeding portion 3 in the curl guide 50, and is disposed on an outer side in the radial direction of the loop Ru formed by the wire W.

The curl forming portion 5 includes a guide member moving mechanism 54 that retracts the guide member 53*a*. After the wire W is wound around the reinforcing bars S, the guide member moving mechanism 54 retracts the guide member 53*a* in conjunction with an operation of the binding portion 7. Details of the guide member moving mechanism 54 will be described later.

The cutting portion 6 includes a fixed blade portion 60, a movable blade portion 61 that cuts the wire W in cooperation with the fixed blade portion 60, and a transmission mechanism 62 that transmits the operation of the binding portion 7 to the movable blade portion 61. The cutting portion 6 cuts the wire W by a rotational operation of the movable blade portion 61 with the fixed blade portion 60 as a fulcrum shaft. The transmission mechanism 62 transmits the operation of the binding portion 7 to the movable blade portion 61 via a transmission member 75 which will be described later, rotates the movable blade portion 61 in conjunction with the operation of the binding portion 7, and cuts the wire W.

The binding portion 7 includes a wire locking body 70 in which the wire W is locked, and a sleeve 71 that actuates the wire locking body 70. A detailed configuration of the binding portion 7 will be described later. The driving portion 8 includes a motor 80 and a speed reducer 81 that performs deceleration and torque amplification.

When the reinforcing bar binding machine 1A is used by being held by a hand of a worker, the reinforcing bar binding machine 1A includes a handle portion 11 on the main body portion 10 and a battery attaching portion 15 via which a battery is detachably attached on the handle portion 11.

The reinforcing bar binding machine 1A includes a feed regulating portion 90 against which a distal end of the wire W abuts in the feeding path of the wire W that is fed in the forward direction by the wire feeding portion 3, that passes through the curl forming portion 5, and that is wound around the reinforcing bars S.

The reinforcing bar binding machine 1A includes, at an end portion of the main body portion 10 between the curl guide 50 and the leading guide 51, abutting portions 91 against which the reinforcing bars S inserted between the curl guide 50 and the leading guide 51 abut. A pair of left and right abutting portions 91 are provided substantially orthogonal to a direction in which the curl guide 50 and the leading guide 51 are arranged.

Further, the reinforcing bar binding machine 1A includes an opening portion 92 at the end portion of the main body portion 10 between the curl guide 50 and the leading guide 51. The opening portion 92 is implemented by providing an opening through which the wire W after being bound can pass, at the end portion of the main body portion 10 between the pair of abutting portions 91 on the left and right sides between the curl guide 50 and the leading guide 51.

The reinforcing bar binding machine 1A includes a wire locking body exposure portion 93 inside the main body portion 10 inside the opening portion 92. The wire locking body exposure portion 93 is implemented by a space inside the main body portion 10 which is partitioned by a wall portion 93*a*, and communicates with the opening portion 92.

In the wire locking body exposure portion 93, a part of the wire locking body 70 is exposed from a hole portion 93*b* provided on one surface of the wall portion 93*a*. The wire locking body exposure portion 93 constitutes a path through which the wire W locked by the wire locking body 70 is fed.

<Configuration Example of Guide Member Moving Mechanism>

Figure 3A:
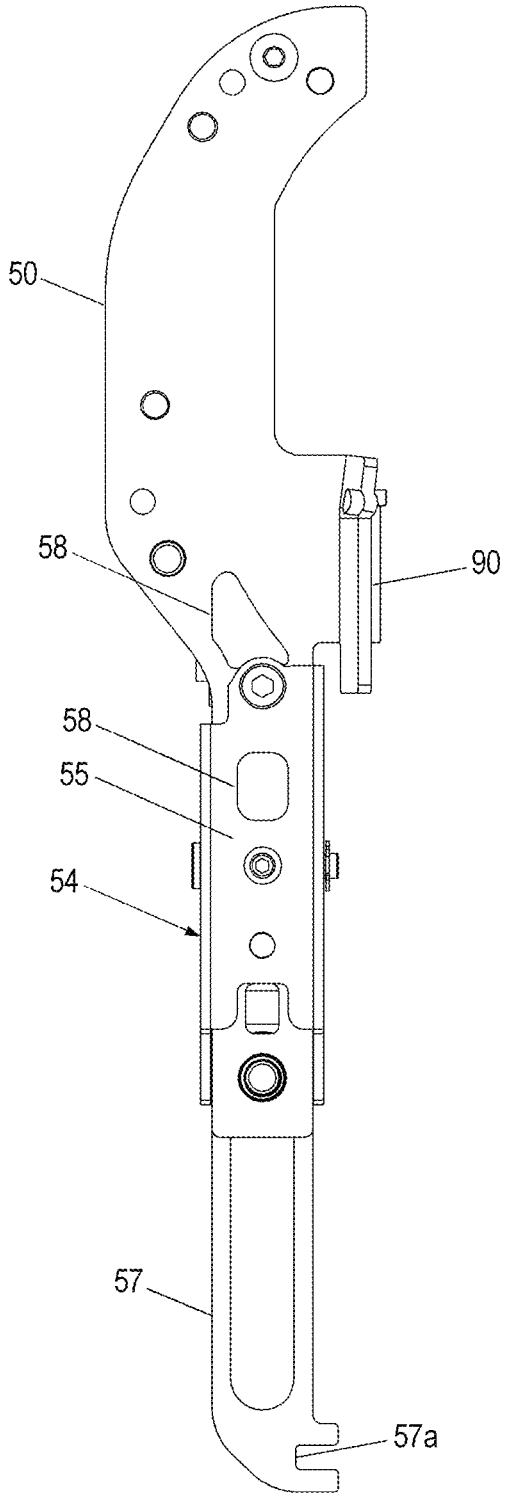
FIG. 3A is a side view illustrating an example of a guide member moving mechanism as viewed from one direction.
Figure 3B:
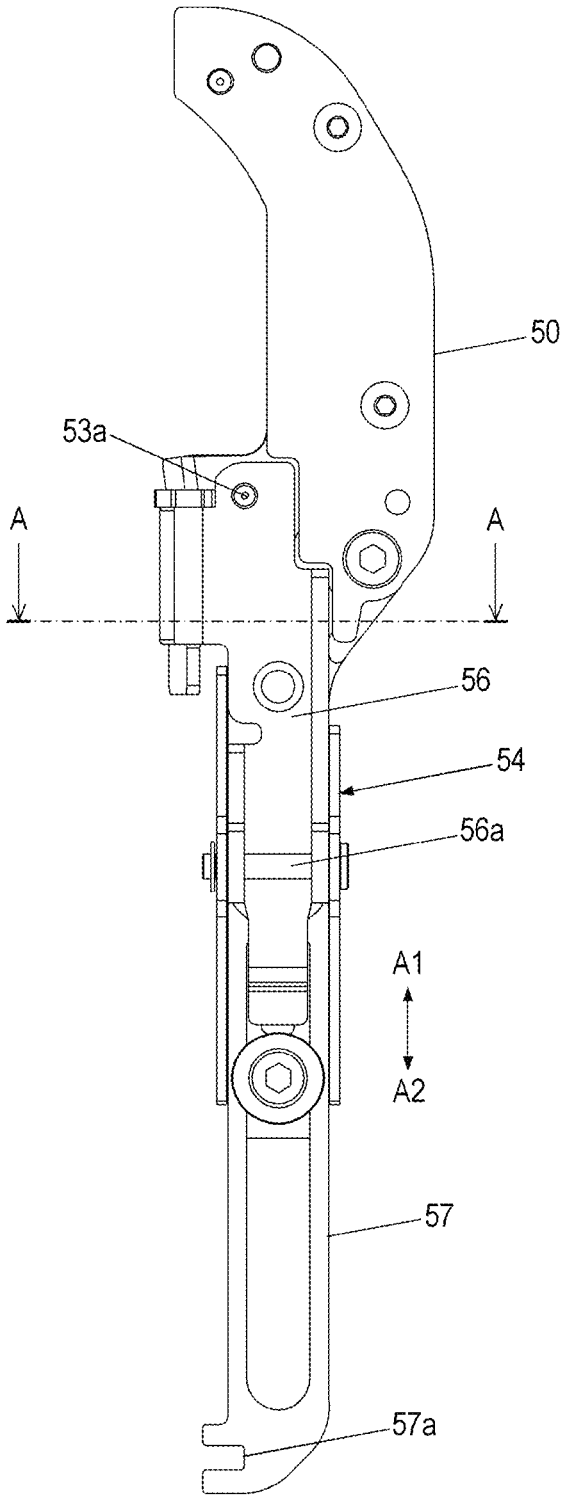
FIG. 3B is a side view illustrating the example of the guide member moving mechanism as viewed from another direction.
Figure 3C:
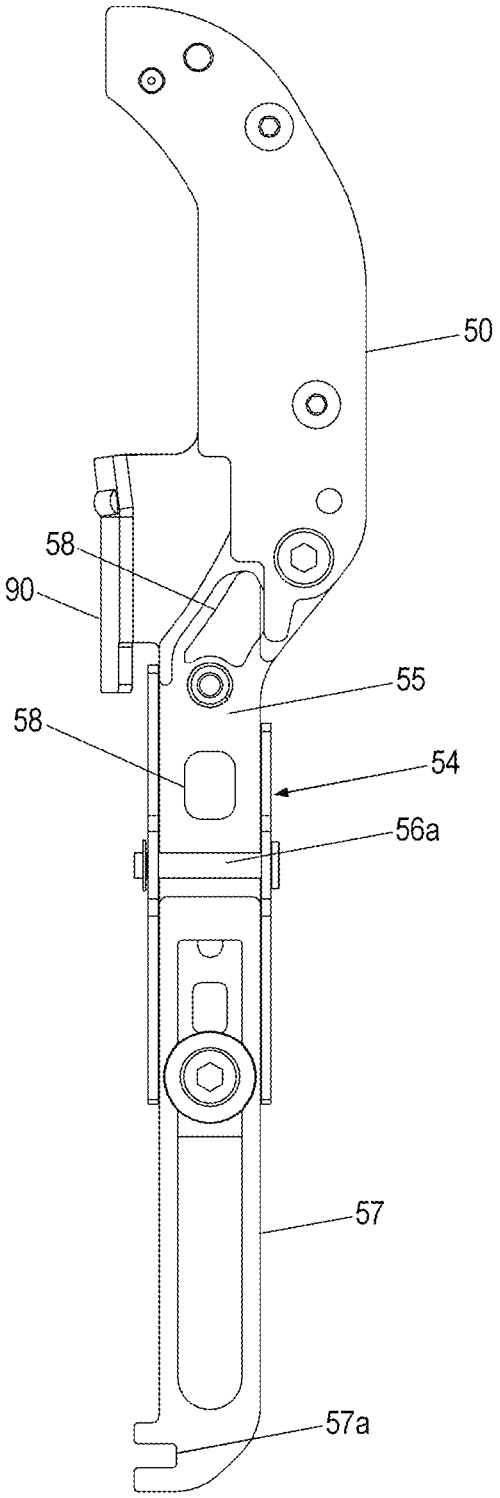
FIG. 3C is a side view illustrating the example of the guide member moving mechanism as viewed from the other direction while removing some parts.
Figure 4A:
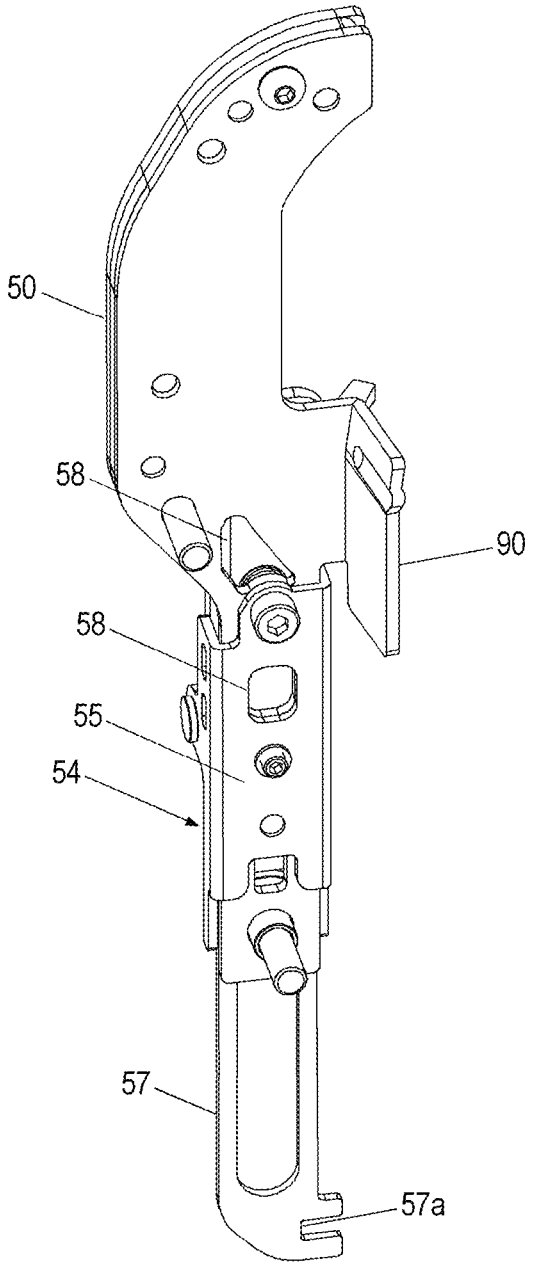
FIG. 4A is a perspective view illustrating the example of the guide member moving mechanism as viewed from the one direction.
Figure 4B:
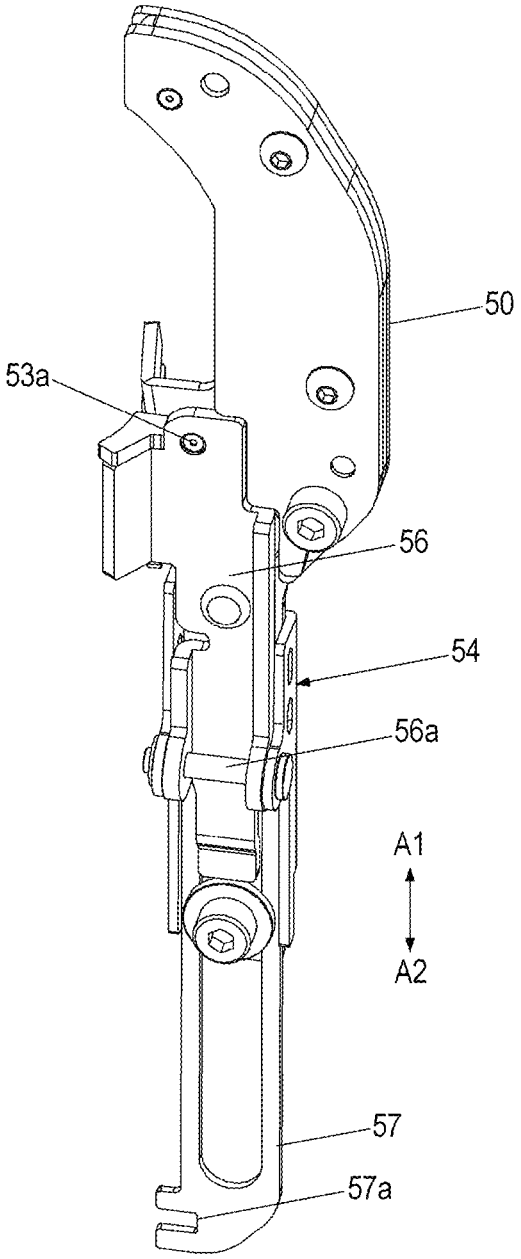
FIG. 4B is a perspective view illustrating the example of the guide member moving mechanism as viewed from the other direction.
Figure 4C:
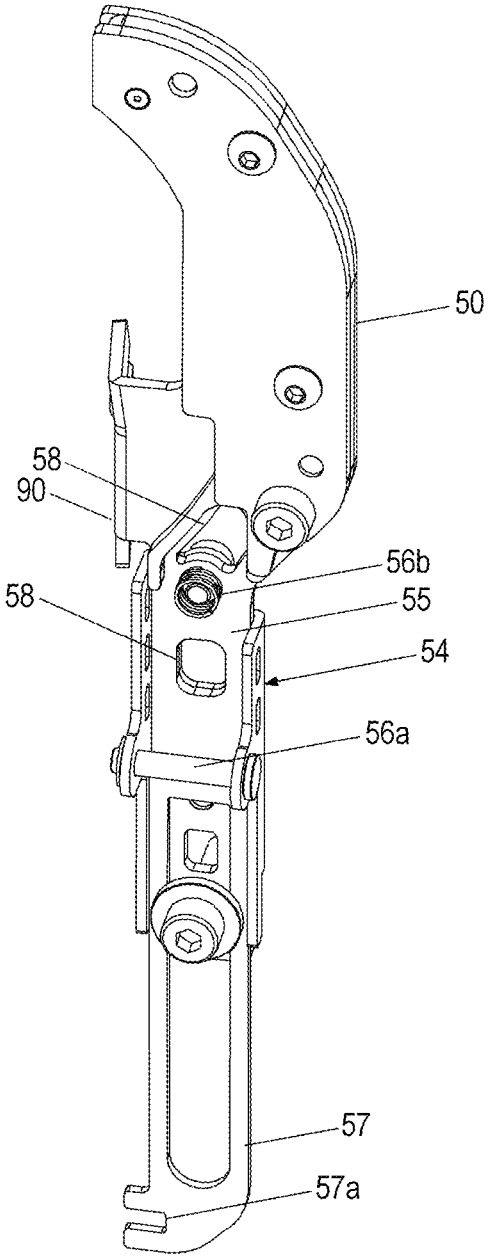
FIG. 4C is a perspective view illustrating the example of the guide member moving mechanism as viewed from the other direction while removing some parts.
Figure 5:
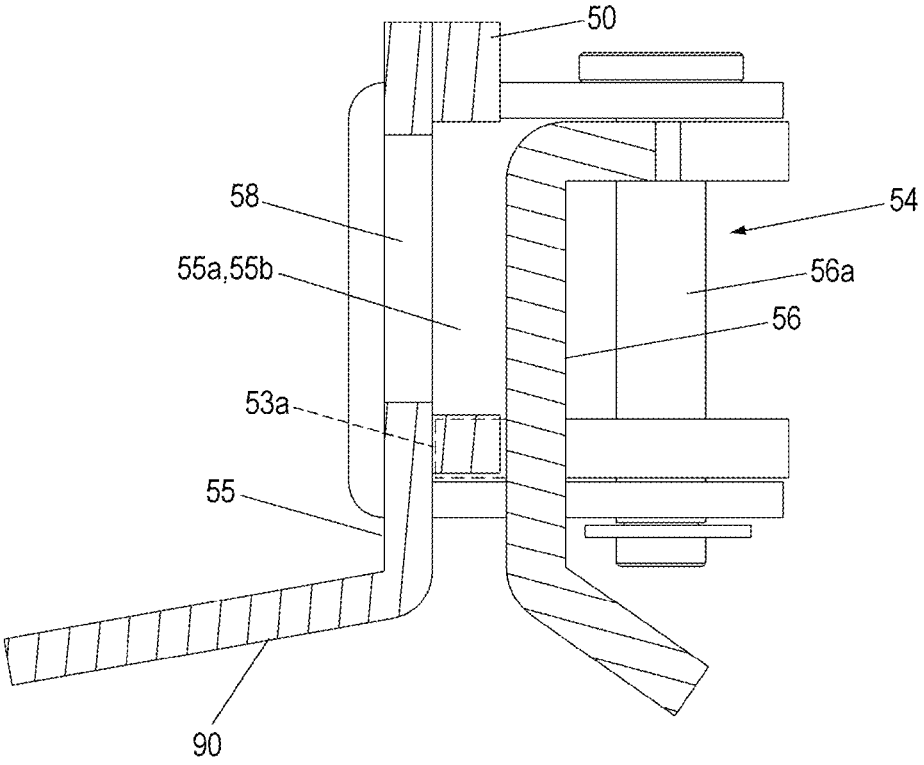
FIG. 5 is a front cross-sectional view illustrating the example of the guide member moving mechanism.

FIG. 3A is a side view illustrating an example of the guide member moving mechanism as viewed from one direction, FIG. 3B is a side view illustrating the example of the guide member moving mechanism as viewed from another direction, and FIG. 3C is a side view illustrating the example of the guide member moving mechanism as viewed from the other direction while removing some parts. FIG. 4A is a perspective view illustrating the example of the guide member moving mechanism as viewed from the one direction, FIG. 4B is a perspective view illustrating the example of the guide member moving mechanism as viewed from the other direction, and FIG. 4C is a perspective view illustrating the example of the guide member moving mechanism as viewed from the other direction while removing some parts. Further, FIG. 5 is a front cross-sectional view illustrating the example of the guide member moving mechanism. FIG. 5 is a simplified cross-sectional view taken along a line A-A in FIG. 3B.

Hereinafter, a configuration of the guide member moving mechanism 54 and a configuration for suppressing foreign objects that enter into the guide member moving mechanism 54 from accumulating will be described with reference to the drawings.

The guide member moving mechanism 54 includes a supporting member 55 fixed to the main body portion 10, and a movable member 56 that is movably supported by the supporting member 55 by, for example, a rotational operation and that is configured to move the guide member 53*a*.

The supporting member 55 is an example of a supporting portion, has a shape extending along a moving direction of the sleeve 71 indicated by arrows A1 and A2, and is fixed inside the main body portion 10 in a direction along the moving direction of the sleeve 71. The curl guide 50 is fixed to one end portion of the supporting member 55.

The movable member 56 is an example of a displacement portion, and has a shape extending along the supporting member 55, and the guide member 53*a* is fixed to one end portion side of the movable member 56. The guide member 53*a* is a columnar or cylindrical member that protrudes from the movable member 56 toward the supporting member 55.

The other end portion side of the movable member 56 is supported by the supporting member 55 via a shaft 56*a*. An axial direction of the shaft 56*a* is orthogonal to an extending direction of the movable member 56 and a protruding direction of the guide member 53*a*. Accordingly, by an operation in which the movable member 56 rotates with the shaft 56*a* as a fulcrum with respect to the supporting member 55, the guide member 53*a* is moved in a direction in which the guide member 53*a* approaches the supporting member 55 and a direction in which the guide member 53*a* is moved away from the supporting member 55.

In the guide member moving mechanism 54, a path 55*a* through which the wire W fed by the wire feeding portion 3 passes is formed between the supporting member 55 and the movable member 56. In the guide member moving mechanism 54, a movable member movement region 55*b* is formed along a moving direction of the movable member 56 that is moved by the rotational operation with the shaft 56*a* as a fulcrum.

The movable member 56 is moved, by the rotational operation with the shaft 56*a* as a fulcrum, between a closed position at which the guide member 53*a* protrudes to the path 55*a* and constitutes a part of the path 55*a* and an open position at which the guide member 53*a* is retracted from the path 55*a*. When the movable member 56 is moved to the closed position and protrudes to the path 55*a*, the guide member 53*a* curls the wire W fed by the wire feeding portion 3, and constitutes a part of the path for winding the wire W around the reinforcing bars S.

When the movable member 56 is moved to the closed position which is a first position, the guide member 53*a* is moved to a position at which an end portion of the guide member 53*a* in an axial direction comes into contact with the supporting member 55, or is moved to a position at which an interval between the end portion of the guide member 53*a* in the axial direction and the supporting member 55 is less than a diameter of the wire W such that the wire W cannot pass through, and the path 55*a* is formed between the supporting member 55 and the movable member 56.

In the configuration in which the reinforcing bar binding machine 1A binds the reinforcing bars S with two wires W, in a state in which the movable member 56 is moved to the closed position, an interval between the supporting member 55 and the movable member 56 at a site where the path 55*a* is formed is slightly longer than twice the diameter of the wire W.

When the movable member 56 is moved from the closed position to the open position which is a second position, the interval between the movable member 56 and the supporting member 55 increases. The movable member movement region 55*b* is a region formed along the moving direction of the movable member 56 that is moved between the closed position and the open position, and is formed between the supporting member 55 and the movable member 56. The movable member movement region 55*b* is formed outside the movable member 56 on a side opposite to the supporting member 55.

The movable member 56 includes a biasing member 56*b* that is biased in a direction away from the supporting member 55. The biasing member 56*b* is implemented by a coil spring in this example, and is provided between the movable member 56 and the supporting member 55 and between the guide member 53*a* and the shaft 56*a*, with directions in which the coil spring expands and contracts as the directions along the direction in which the movable member 56 approaches the supporting member 55 and the direction in which the movable member 56 is moved away from the supporting member 55.

The guide member moving mechanism 54 includes an actuating member 57 that actuates the movable member 56. The actuating member 57 has a shape extending along the moving direction of the sleeve 71, and is supported by the supporting member 55 in a manner of being movable in the directions indicated by the arrow A1 and the arrow A2 opposite to the arrow A1 along the moving direction of the sleeve 71.

The actuating member 57 is moved in the directions indicated by the arrows A1 and A2 to rotate the movable member 56 with the shaft 56*a* as a fulcrum. When the actuating member 57 is moved in the direction indicated by the arrow A1, the actuating member 57 is retracted from a position at which the movable member 56 is suppressed from rotating in an opening direction. Accordingly, the movable member 56 rotates with the shaft 56*a* as a fulcrum in the direction in which the guide member 53*a* is moved away from the supporting member 55 by a force generated by restoring of the biasing member 56*b*, and is moved to the open position.

In contrast, when the actuating member 57 is moved in the direction indicated by the arrow A2, the actuating member 57 protrudes to a position at which the movable member 56 is suppressed from rotating in the opening direction in which the guide member 53*a* is moved away from the supporting member 55, and holds the movable member 56 at the closed position.

The actuating member 57 is coupled to the transmission member 75 provided on the sleeve 71 by a coupling portion 57*a*, and is moved in the directions indicated by the arrow A1 and the arrow A2 opposite to the arrow A1 in conjunction with the movement of the sleeve 71. The transmission member 75 is attached to the sleeve 71 and is moved in the directions indicated by the arrows A1 and A2 in conjunction with the movement of the sleeve 71 in the directions indicated by the arrows A1 and A2. The transmission member 75 is rotatable with respect to the sleeve 71, and the transmission member 75 does not rotate even when the sleeve 71 rotates.

Accordingly, as the sleeve 71 is moved in the direction indicated by the arrow A1, the actuating member 57 is moved in the direction indicated by the arrow A1. When the actuating member 57 is moved in the direction indicated by the arrow A1, the movable member 56 rotates in the direction in which the guide member 53*a* is moved away from the supporting member 55.

As the sleeve 71 is moved in the direction indicated by the arrow A2, the actuating member 57 is moved in the direction indicated by the arrow A2. When the actuating member 57 is moved in the direction indicated by the arrow A2, the movable member 56 rotates in the direction in which the guide member 53*a* approaches the supporting member 55.

The guide member moving mechanism 54 includes an accumulation suppressing portion 58 that suppresses foreign objects that enter into the path 55*a* and the movable member movement region 55*b* between the supporting member 55 and the movable member 56 from accumulating. The accumulation suppressing portion 58 is implemented by providing an opening communicating with the movable member movement region 55*b* and penetrating the front and back of the supporting member 55 in a part of a site of the supporting member 55 facing the movable member 56.

Accordingly, an area of a site where the supporting member 55 and the movable member 56 face each other between surfaces is reduced, and by the movement of the movable member 56 in the direction in which the movable member 56 approaches the supporting member 55, foreign objects that enter into the path 55*a* and the movable member movement region 55*b* between the supporting member 55 and the movable member 56 are suppressed from being sandwiched between the movable member 56 and the supporting member 55. The foreign objects that enter into the path 55*a* and the movable member movement region 55*b* between the supporting member 55 and the movable member 56 are discharged through the accumulation suppressing portion 58 from between the supporting member 55 and the movable member 56. The accumulation suppressing portion 58 may be implemented by providing an opening communicating with the movable member movement region 55*b* and penetrating the front and back of the movable member 56 in a part of a site of the movable member 56 facing the supporting member 55.

<Configuration Example of Binding Portion>

Figure 6A:
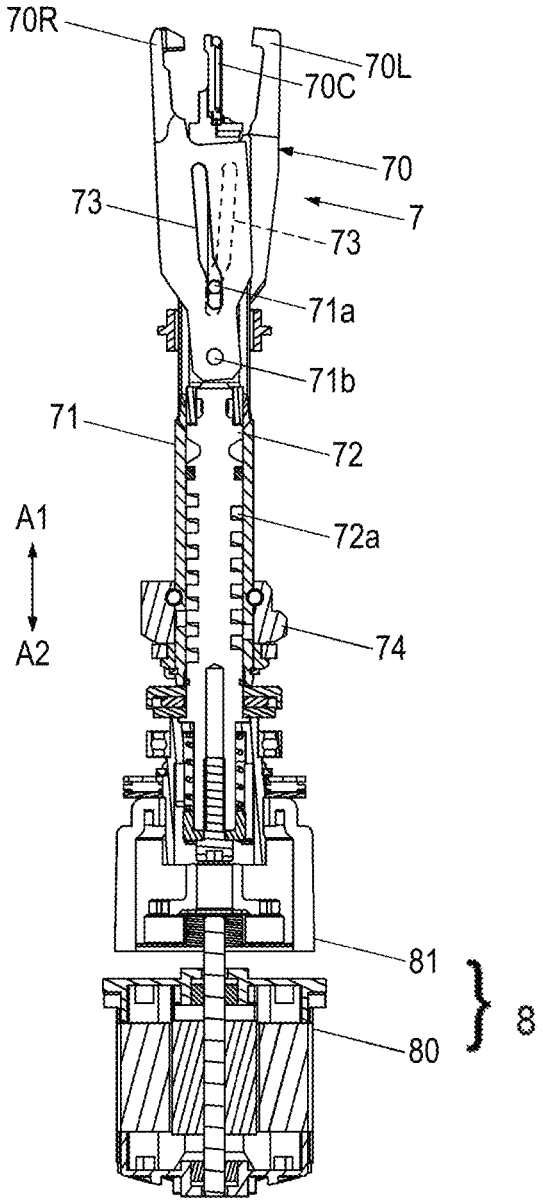
FIG. 6A is a cross-sectional plan view illustrating an example of a binding portion.
Figure 6B:
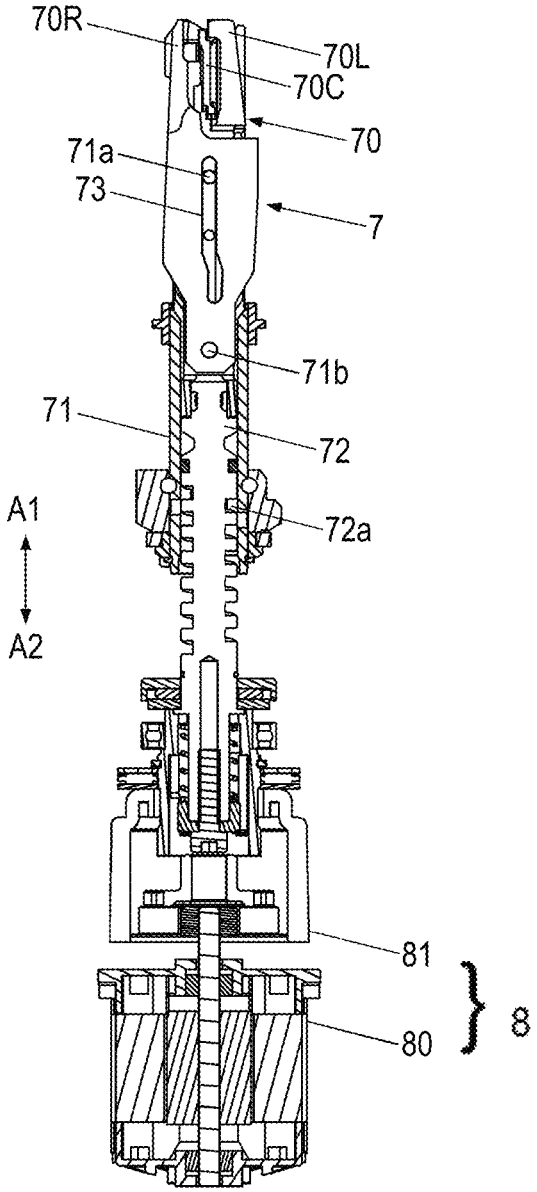
FIG. 6B is a cross-sectional plan view illustrating the example of the binding portion.

FIGS. 6A and 6B are cross-sectional plan views each illustrating an example of the binding portion, and next, a configuration of the bundling portion will be described with reference to the drawings.

The binding portion 7 includes a rotation shaft 72 that actuates the wire locking body 70 and the sleeve 71. In the binding portion 7 and the driving portion 8, the rotation shaft 72 and the motor 80 are coupled via the speed reducer 81, and the rotation shaft 72 is driven by the motor 80 via the speed reducer 81.

The wire locking body 70 includes a center hook 70C coupled to the rotation shaft 72, a first side hook 70R and a second side hook 70L that open and close with respect to the center hook 70C.

The center hook 70C is coupled to a distal end of the rotation shaft 72, which is one end portion of the rotation shaft 72 in an axial direction, via a configuration capable of rotating with respect to the rotation shaft 72 and capable of moving integrally with the rotation shaft 72 in the axial direction.

In the wire locking body 70, by a rotational operation with a shaft 71*b* as a fulcrum, a distal end side of the first side hook 70R opens and closes in a direction in which the distal end side of the first side hook 70R comes into contact with or separates from the center hook 70C. A distal end side of the second side hook 70L opens and closes in a direction in which the distal end side of the second side hook 70L comes into contact with or separates from the center hook 70C.

The sleeve 71 includes a convex portion (not illustrated) protruding to an inner peripheral surface of a space into which the rotation shaft 72 is inserted, and the convex portion enter a groove portion of a feeding screw 72*a* formed along the axial direction on an outer periphery of the rotation shaft 72. When the rotation shaft 72 rotates, the sleeve 71 is moved in a vertical direction, which is a direction along the axial direction of the rotation shaft 72, in accordance with a rotation direction of the rotation shaft 72 due to an action of the convex portion (not illustrated) and the feeding screw 72*a* of the rotation shaft 72. The sleeve 71 rotates integrally with the rotation shaft 72.

The sleeve 71 includes an opening and closing pin 71*a* that opens and closes the first side hook 70R and the second side hook 70L.

The opening and closing pin 71*a* is inserted into an opening and closing guide hole 73 provided in the first side hook 70R and the second side hook 70L. The opening and closing guide hole 73 extends along the moving direction of the sleeve 71, and has a shape that converts a linear motion of the opening and closing pin 71*a* that is moved in conjunction with the sleeve 71 into an opening and closing operation due to rotation of the first side hook 70R and the second side hook 70L with the shaft 71*b* as a fulcrum.

In the wire locking body 70, when the sleeve 71 is moved in a downward direction indicated by the arrow A2, the first side hook 70R and the second side hook 70L are moved in a direction away from the center hook 70C by the rotational operation with the shaft 71*b* as a fulcrum due to a trajectory of the opening and closing pin 71*a* and the shape of the opening and closing guide hole 73.

Accordingly, the first side hook 70R and the second side hook 70L are opened with respect to the center hook 70C, and a feeding path through which the wire W passes is respectively formed between the first side hook 70R and the center hook 70C and between the second side hook 70L and the center hook 70C.

In the state in which the first side hook 70R and the second side hook 70L are opened with respect to the center hook 70C, the wire W fed by the wire feeding portion 3 passes between the center hook 70C and the first side hook 70R. The wire W that passes between the center hook 70C and the first side hook 70R is leaded to the curl forming portion 5. The wire W curled by the curl forming portion 5 and leaded to the binding portion 7 passes between the center hook 70C and the second side hook 70L.

In the wire locking body 70, when the sleeve 71 is moved in an upward direction indicated by the arrow A1, the first side hook 70R and the second side hook 70L are moved in a direction in which the first side hook 70R and the second side hook 70L approach the center hook 70C by the rotational operation with the shaft 71*b* as a fulcrum due to the trajectory of the opening and closing pin 71*a* and the shape of the opening and closing guide hole 73. Accordingly, the first side hook 70R and the second side hook 70L are closed with respect to the center hook 70C.

When the first side hook 70R is closed with respect to the center hook 70C, the wire W sandwiched between the first side hook 70R and the center hook 70C is locked in a manner of being capable of moving between the first side hook 70R and the center hook 70C. When the second side hook 70L is closed with respect to the center hook 70C, the wire W sandwiched between the second side hook 70L and the center hook 70C is locked in a manner that the wire W does not come out from between the second side hook 70L and the center hook 70C.

The sleeve 71 includes a bending portion 71*c*1 that forms the wire W into a predetermined shape by bending a distal end side, which is one end portion of the wire W, in a predetermined direction, and a bending portion 71*c*2 that forms the wire W into a predetermined shape by bending a terminal end side, which is the other end portion of the wire W cut by the cutting portion 6, in a predetermined direction.

When the sleeve 71 is moved in the upward direction indicated by the arrow A1, the distal end side of the wire W locked by the center hook 70C and the second side hook 70L is pressed by the bending portion 71*c*1 and bent toward the reinforcing bar S. When the sleeve 71 is moved in the upward direction indicated by the arrow A1, the terminal end side of the wire W, which is locked by the center hook 70C and the first side hook 70R and cut by the cutting portion 6, is pressed by the bending portion 71*c*2 and bent toward the reinforcing bar S.

The binding portion 7 includes a rotation regulating portion 74 that regulates the rotations of the wire locking body 70 and the sleeve 71 which are in conjunction with a rotational operation of the rotation shaft 72. In the binding portion 7, the rotation regulating portion 74 regulates the rotation of the sleeve 71 which is in conjunction with the rotation of the rotation shaft 72 according to a position of the sleeve 71 along the axial direction of the rotation shaft 72, and the sleeve 71 is moved in the directions indicated by the arrows A1 and A2 by the rotational operation of the rotation shaft 72.

Accordingly, the sleeve 71 is moved in the direction indicated by the arrow A1 without rotating, whereby the first side hook 70R and the second side hook 70L are closed with respect to the center hook 70C, and the wire W is locked. The sleeve 71 is moved in the direction indicated by the arrow A2 without rotating, whereby the first side hook 70R and the second side hook 70L are opened with respect to the center hook 70C, and the locking of the wire W is released.

In the binding portion 7, when the regulation of the rotation of the sleeve 71 by the rotation regulating portion 74 is released, the sleeve 71 rotates in conjunction with the rotation of the rotation shaft 72.

Accordingly, the first side hook 70R and the second side hook 70L and the center hook 70C which lock the wire W rotate, and the locked wire W is twisted.

<Configuration Example for Discharging Foreign Object>

Figure 7A:
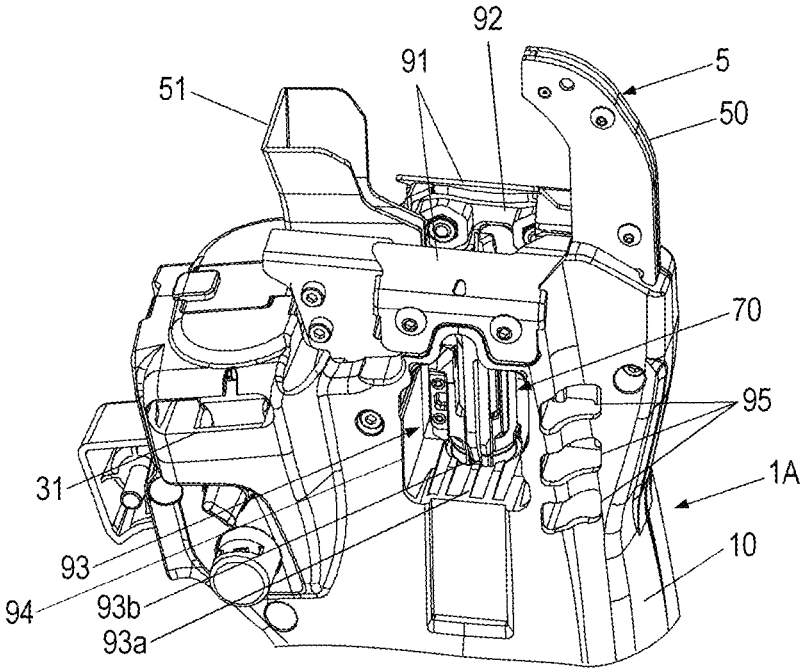
FIG. 7A is a main portion perspective view illustrating the example of the reinforcing bar binding machine
Figure 7B:
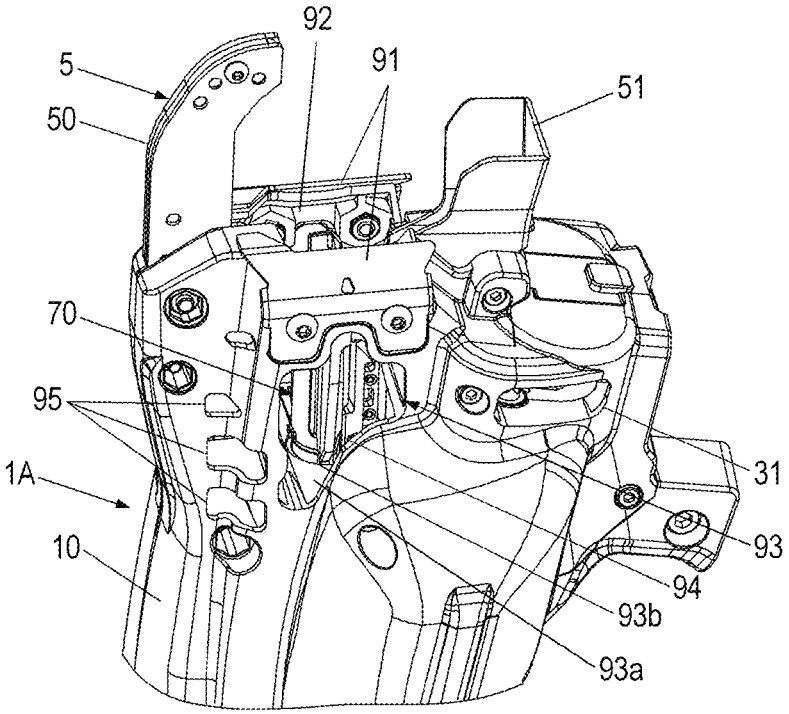
FIG. 7B is a main portion perspective view illustrating the example of the reinforcing bar binding machine

FIGS. 7A and 7B are main portion perspective views each illustrating the example of the reinforcing bar binding machine, and next, a configuration for discharging foreign objects from the inside of the main body portion 10 will be described with reference to the drawings.

The reinforcing bar binding machine 1A includes a discharging portion 31 that mainly discharges foreign objects or the like generated in the wire feeding portion 3 and the wire guide 4 due to rubbing of the wire W fed by the wire feeding portion 3 to the outside of the main body portion 10. The discharging portion 31 is implemented by providing an opening that communicates with a space into which the pair of feeding gears 30 and the like enter, on at least one side, in this example, both sides of the main body portion 10.

The reinforcing bar binding machine 1A includes a discharging portion 94 that discharges foreign objects inside the wire locking body exposure portion 93 to the outside of the main body portion 10. The discharging portion 94 is implemented by providing an opening that communicates with the wire locking body exposure portion 93, on at least one side, in this example, both sides of the main body portion 10.

In the wire locking body 70, the center hook 70C, the first side hook 70R, the second side hook 70L, and a distal end side of the sleeve 71 are exposed to the wire locking body exposure portion 93 from the hole portion 93*b* provided on the wall portion 93*a* of the wire locking body exposure portion 93.

Accordingly, the wire locking body exposure portion 93 constitutes a path through which the wire W which passes through the cutting portion 6 and which is fed to between the center hook 70C and the first side hook 70R passes, and a path through which the wire W which passes between the center hook 70C and the first side hook 70R and which is fed to the curl forming portion 5 passes. The wire locking body exposure portion 93 constitutes a path through which the wire W which is curled by the curl forming portion 5 and which is fed between the center hook 70C and the second side hook 70L passes, and a path through which the wire W which passes between the center hook 70C and the second side hook 70L and which abuts against the feed regulating portion 90 passes.

The reinforcing bar binding machine 1A includes a discharging portion 95 that discharges foreign objects in a site where the guide member moving mechanism 54 is provided to the outside of the main body portion 10. The discharging portion 95 is implemented by providing an opening communicating with the site where the guide member moving mechanism 54 is provided, on at least one side portion, in this example, both side portions of the main body portion 10 covered with the exterior having a predetermined shape. The discharging portion 95, which is provided on the side portion of the main body portion 10 on the side where the supporting member 55 is provided, communicates with the opening of the supporting member 55 constituting the accumulation suppressing portion 58.

The discharging portion 95 provided on one side portion of the main body portion 10 is connected to the accumulation suppressing portion 58 provided on the supporting member 55 of the guide member moving mechanism 54. Accordingly, foreign objects that enter into the path 55*a* and the movable member movement region 55*b* between the supporting member 55 and the movable member 56 are discharged from between the supporting member 55 and the movable member 56 to the outside of the main body portion 10 through the accumulation suppressing portion 58 and the discharging portion 95.

<Configuration Example of Binding Device>

Figure 8A:
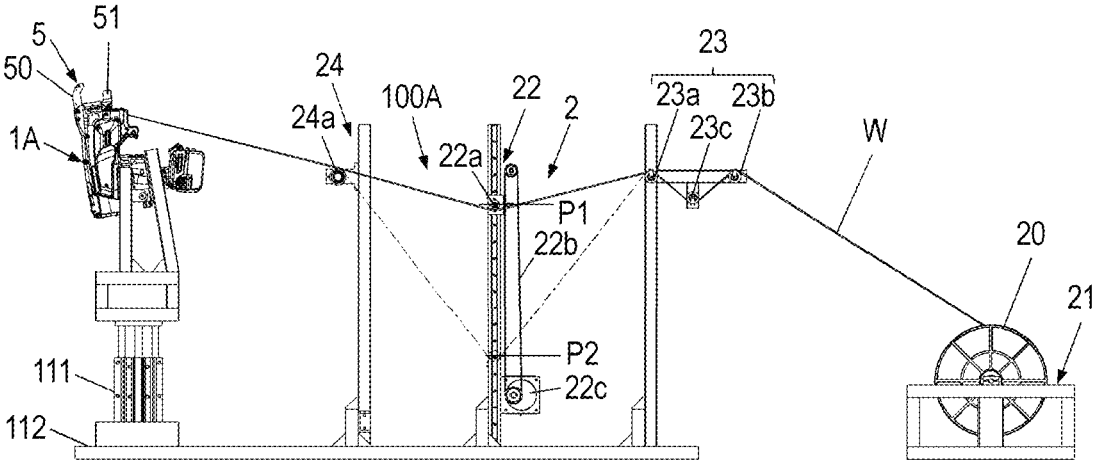
FIG. 8A is a side view illustrating an example of a binding device according to the present embodiment.
Figure 8B:
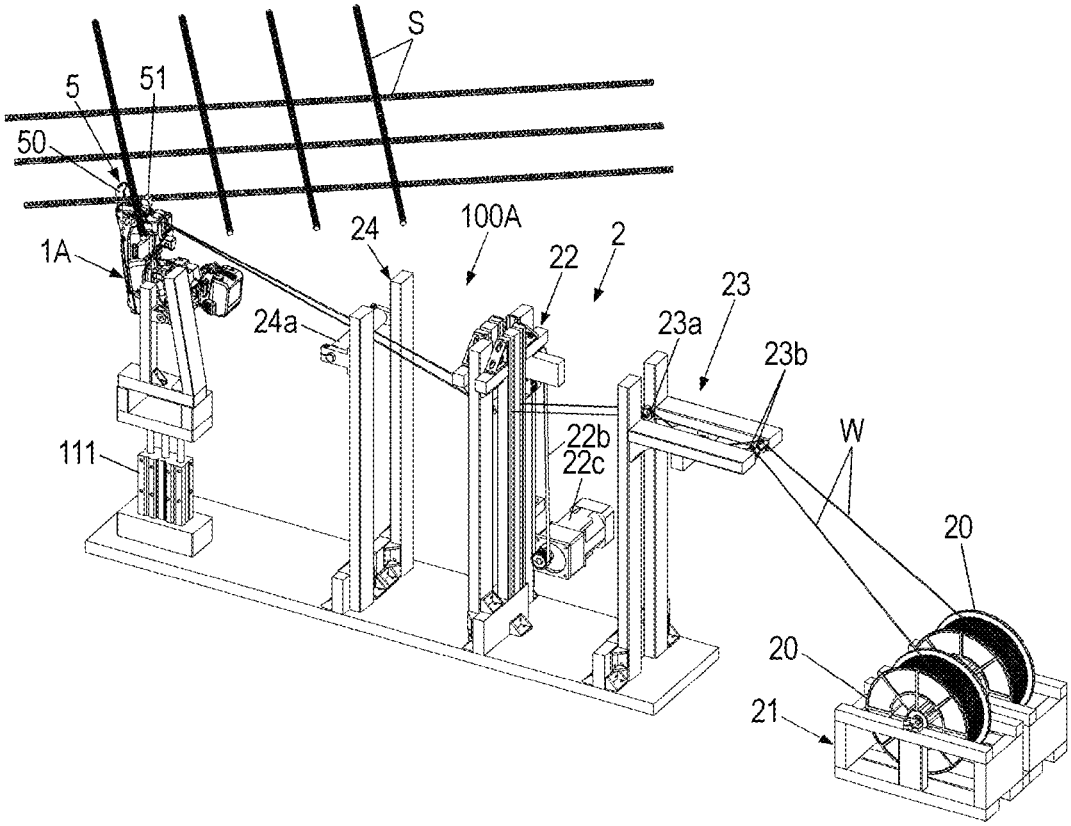
FIG. 8B is a perspective view illustrating the example of the binding device according to the present embodiment.

FIG. 8A is a side view illustrating an example of the binding device according to the present embodiment, and FIG. 8B is a perspective view illustrating the example of the binding device according to the present embodiment.

A binding device 100A includes the reinforcing bar binding machine 1A that binds the reinforcing bars S with the wire W, a reel accommodating portion 21 in which the wire W is accommodated in a manner of being capable of being drawn out, and a wire feeding mechanism 2 that draws out the wire W accommodated in the reel accommodating portion 21. In order for the reinforcing bar binding machine 1A to be able to move (move up and down) in a vertical direction which is a direction intersecting a disposition plane of the reinforcing bars S, the reinforcing bar binding machine 1A is attached to an elevation mechanism 111 and is supported by a base portion 112.

The reinforcing bar binding machine 1A applied to the binding device 100A is moved in the vertical direction which is a direction intersecting the disposition plane of the reinforcing bars S, and the reinforcing bars S are taken in and out of the curl forming portion 5. Therefore, the reinforcing bar binding machine 1A is attached to the elevation mechanism 111 in an upward direction in which the curl forming portion 5 is positioned at the upper end portion of the main body portion 10.

The reel accommodating portion 21 is an example of an accommodating portion, and rotatably and detachably accommodates a reel 20, around which the wire W is wound in a manner of being capable of being drawn out. The reel 20 is implemented in a manner that one wire W is wound around a hub portion (not illustrated), and the wire W is capable of being drawn out from the reel 20.

In a case in which the reinforcing bars S are bound by two wires W in the reinforcing bar binding machine 1A, in the present example, two reels 20 are accommodated side by side along an axial direction with a rotation shaft oriented horizontally with respect to the vertical direction in the reel accommodating portion 21.

The wire feeding mechanism 2 includes a wire drawing mechanism 22 that feeds the wire W between the reinforcing bar binding machine 1A and the reel 20, a first wire leading portion 23 that leads the wire W between the reel 20 and the wire drawing mechanism 22, and a second wire leading portion 24 that leads the wire W between the reinforcing bar binding machine 1A and the wire drawing mechanism 22.

The wire drawing mechanism 22 includes a drawing roller 22*a* that pulls the wire W between the first wire leading portion 23 and the second wire leading portion 24, and a driving portion 22*b* that moves a position of the drawing roller 22*a* in a direction intersecting with the wire W between the first wire leading portion 23 and the second wire leading portion 24. When the driving portion 22*b* is driven by a motor 22*c*, the drawing roller 22*a* is moved between an upper limit position P1 serving as a first position which is a standby position and a lower limit position P2 serving as a second position at which the wire W is pulled.

The first wire leading portion 23 includes rollers 23*a*, 23*b*, and 23*c* on an upstream side of the wire drawing mechanism 22 with respect to a feeding direction of the wire W fed from the reel 20 accommodated in the reel accommodating portion 21 to the reinforcing bar binding machine 1A. The first wire leading portion 23 leads a path through which the wire W drawn out from the reel 20 accommodated in the reel accommodating portion 21 is fed toward the roller 23*a* by the roller 23*b*, and leads the path toward the second wire leading portion 24 by the roller 23*a*. The roller 23*c* bends the feeding path of the wire W to increase a load to be applied to the wire W leaded by the first wire leading portion 23.

The second wire leading portion 24 includes a roller 24*a* on a downstream side of the wire drawing mechanism 22. The second wire leading portion 24 leads the path through which the wire W is fed toward the reinforcing bar binding machine 1A by the roller 24*a*.

The wire drawing mechanism 22 applies a force to pull the wire W between the reel 20 and the first wire leading portion 23 and the wire W between the reinforcing bar binding machine 1A and the second wire leading portion 24, to a position between the first wire leading portion 23 and the second wire leading portion 24 by the movement of the drawing roller 22*a* from the upper limit position P1 to the lower limit position P2.

Depending on changes in magnitudes of the load applied to the wire W leaded by the first wire leading portion 23 and the load applied to the wire W leaded by the second wire leading portion 24, whether the wire W closer to the first wire leading portion 23 is fed or the wire W closer to the second wire leading portion 24 is fed is switched. Accordingly, as will be described later, in the reinforcing bar binding machine 1A, a surplus of the wire W generated by an operation of feeding the wire W in the reverse direction and winding the wire W with the reinforcing bars S is absorbed, and the wire W is drawn out from the reel 20 accommodated in the reel accommodating portion 21. The binding device 100A may be implemented by a self-propelled configuration including a wheel, an endless track, or the like, and a driving portion such as a motor that drives the wheel, the endless track, or the like.

<Operation Example of Reinforcing Bar Binding Machine and Binding Device>

Next, an operation of binding the reinforcing bars S with the wire W by the reinforcing bar binding machine 1A in the binding device 100A will be described with reference to the drawings.

The binding device 100A moves the reinforcing bars S such that a position to be bound at which the reinforcing bars S intersect is a position facing the curl forming portion 5 of the reinforcing bar binding machine 1A, and moves the reinforcing bar binding machine 1A such that the position to be bound of the reinforcing bars S enters between the curl guide 50 and the leading guide 51 of the curl forming portion 5.

The reinforcing bar binding machine 1A drives the feeding motor (not illustrated) in a forward rotation direction, and feeds the wire W in the forward direction indicated by the arrow F by the wire feeding portion 3. In the wire feeding portion 3, two wires W are fed in parallel along the axial direction of the loop Ru formed by the wires W.

The wire W fed in the forward direction passes between the center hook 70C and the first side hook 70R and is fed to the curl guide 50 of the curl forming portion 5. By passing through the curl guide 50, the wire W is curled around the reinforcing bars S by the guide members 53*a* and 53*b*.

The wire W curled by the curl guide 50 is leaded to the leading guide 51, and is further fed in the forward direction by the wire feeding portion 3, whereby the wire W is leaded to between the center hook 70C and the second side hook 70L by the leading guide 51. Then, the wire W is fed until the distal end of the wire W abuts against the feed regulating portion 90. Since the feeding path of the wire W fed by the wire feeding portion 3 is regulated by the curl forming portion 5, the trajectory of the wire W becomes the loop Ru as illustrated in FIG. 2, and the wire W is wound around the reinforcing bars S. When the distal end of the wire W is fed to a position at which the distal end of the wire W abuts against the feed regulating portion 90, driving of the feeding motor (not illustrated) is stopped.

After the feeding of the wire W in the forward direction is stopped, the motor 80 is driven in the forward rotation direction. In an operation region in which the rotation regulating portion 74 regulates the rotation of the sleeve 71 in conjunction with the rotation of the rotation shaft 72, the rotational operation of the rotation shaft 72 is converted into linear movement, and the sleeve 71 is moved in the direction indicated by the arrow A1 which is the upward direction.

When the sleeve 71 is moved in the direction indicated by the arrow A1, the opening and closing pin 71*a* passes through the opening and closing guide holes 73. Accordingly, as illustrated in FIG. 6B, the first side hook 70R is moved in the direction in which the first side hook 70R approaches the center hook 70C by the rotational operation with the shaft 71*b* as a fulcrum. When the first side hook 70R is closed with respect to the center hook 70C, the wire W sandwiched between the first side hook 70R and the center hook 70C is locked in a manner of being capable of moving between the first side hook 70R and the center hook 70C.

The second side hook 70L is moved in the direction in which the second side hook 70L approaches the center hook 70C by the rotational operation with the shaft 71*b* as a fulcrum. When the second side hook 70L is closed with respect to the center hook 70C, the wire W sandwiched between the second side hook 70L and the center hook 70C is locked in a manner that the wire W does not come out from between the second side hook 70L and the center hook 70C.

Further, when the sleeve 71 is moved in the direction indicated by the arrow A1, the actuating member 57 of the guide member moving mechanism 54, which is coupled to the transmission member 75 provided on the sleeve 71 by the coupling portion 57*a*, is moved in the direction indicated by the arrow A1 in conjunction with the movement of the sleeve 71. When the actuating member 57 is moved in the direction indicated by the arrow A1, the movable member 56 is moved to the open position by the rotational operation with the shaft 56*a* as a fulcrum, and the guide member 53*a* is retracted from the path 55*a*. The motor 80 that moves the sleeve 71 functions as a driving portion that drives the movable member 56, which is a displacement portion.

After the wire W is locked by the closing operations of the first side hook 70R and the second side hook 70L and the sleeve 71 is moved to an end point position of the operation region in which the guide member 53*a* is retracted from the path 55*a*, the rotation of the motor 80 is temporarily stopped, and the feeding motor (not illustrated) is driven in a reverse rotation direction. Accordingly, the pair of feeding gears 30 rotates in the reverse direction. Therefore, the wire W sandwiched between the pair of feeding gears 30 is fed in the reverse direction indicated by the arrow R.

The wire W wound around the reinforcing bars S and locked by the wire locking body 70 is locked in a manner that a site on the distal end side sandwiched between the second side hook 70L and the center hook 70C does not come out from between the second side hook 70L and the center hook 70C. The wire W locked by the wire locking body 70 is locked in a manner that a site sandwiched between the first side hook 70R and the center hook 70C can move in a circumferential direction of the loop Ru along the feeding path of the wire W between the first side hook 70R and the center hook 70C. Further, the guide member 53*a* is retracted from the path 55*a*.

Accordingly, the wire W wound around the reinforcing bars S is wound with the reinforcing bars S by the operation of feeding the wire W in the reverse direction indicated by the arrow R. During the operation of feeding the wire W in the reverse direction by the reinforcing bar binding machine 1A, the wire W is not fed in the reverse direction in the wire feeding mechanism 2. Therefore, during the operation of feeding the wire W in the reverse direction by the reinforcing bar binding machine 1A, the wire W is loosened between the reinforcing bar binding machine 1A and the second wire leading portion 24.

When the wire W is drawn back to the position at which the wire W is wound with the reinforcing bars S, the driving of the feeding motor (not illustrated) in the reverse rotation direction is stopped, and then the motor 80 is driven in the forward rotation direction to move the sleeve 71 in the upward direction indicated by the arrow A1. When the movement of the sleeve 71 in the direction indicated by the arrow A1 is transmitted to the cutting portion 6, the movable blade portion 61 rotates, and the wire W locked by the first side hook 70R and the center hook 70C is cut by the operations of the fixed blade portion 60 and the movable blade portion 61.

When the wire W is cut, the bending portions 71*c*1 and 71*c*2 are moved in directions in which the bending portions 71*c*1 and 71*c*2 come into contact with the reinforcing bars S. Accordingly, the distal end side of the wire W locked by the center hook 70C and the second side hook 70L is pressed toward the reinforcing bars S by the bending portion 71*c*1, and is bent toward the reinforcing bars S with a locking position as a fulcrum. When the sleeve 71 is further moved in the upward direction, the wire W locked between the second side hook 70L and the center hook 70C is held in a state of being sandwiched by the bending portion 71*c*1.

The terminal end side of the wire W locked by the center hook 70C and the first side hook 70R and cut by the cutting portion 6 is pressed toward the reinforcing bars S by the bending portion 71*c*2, and is bent toward the reinforcing bars S side with a locking position as a fulcrum. When the sleeve 71 is further moved in the direction indicated by the arrow A1, the wire W locked between the first side hook 70R and the center hook is held in a state of being sandwiched by the bending portion 71*c*2.

After the distal end side and the terminal end side of the wire W are bent toward the reinforcing bars S, the motor 80 is further driven in the forward rotation direction, and the sleeve 71 is further moved in the direction indicated by the arrow A1. When the sleeve 71 is moved to a predetermined position and reaches an operation region for twisting the wire W locked by the wire locking body 70, the regulation of the rotation of the sleeve 71 by the rotation regulating portion 74 is released, and the sleeve 71 rotates in conjunction with the rotation of the rotation shaft 72.

Accordingly, when the motor 80 is further driven in the forward rotation direction, the wire locking body 70 rotates in conjunction with the rotation shaft 72, whereby the wire W is twisted and the reinforcing bars S are bound with the wire W. When it is detected that a load applied to the motor 80 reaches a predetermined value, for example, a maximum load, the rotation of the motor 80 in the forward direction is stopped at a predetermined timing.

After the rotation of the motor 80 in the forward direction is stopped, the motor 80 is reversely rotated to move the sleeve 71 in the direction indicated by the arrow A2 to a position at which the first side hook 70R is opened with respect to the center hook 70C and the second side hook 70L is opened with respect to the center hook 70C, thereby returning the wire locking body 70 to a standby position.

When the sleeve 71 is moved in the direction indicated by the arrow A2, the actuating member 57 of the guide member moving mechanism 54 is moved in the direction indicated by the arrow A2 in conjunction with the movement of the sleeve 71. When the actuating member 57 is moved in the direction indicated by the arrow A2, the movable member 56 is moved to the closed position by the rotational operation with the shaft 56*a* as a fulcrum, and the guide member 53*a* protrudes to the path 55*a*.

When the wire W binding the reinforcing bars S is detached from the wire locking body 70, the reinforcing bar binding machine 1A is moved to the standby position.

During the binding operation in the reinforcing bar binding machine 1A, the wire feeding mechanism 2 performs an operation of drawing out a predetermined amount of the wire W from the reel 20 until the wire W is fed in the forward direction in a next binding operation after the wire W is fed in the reverse direction and wound with the reinforcing bars S.

The wire feeding mechanism 2 rotates the motor 22*c* in the forward direction to lower the drawing roller 22*a* from the upper limit position P1. In the wire drawing mechanism 22, the drawing roller 22*a* is lowered from the upper limit position P1 toward the lower limit position P2 along the direction intersecting the wire W between the roller 23*a* of the first wire leading portion 23 and the roller 24*a* of the second wire leading portion 24.

When the drawing roller 22*a* is lowered to the lower limit position P2, the wire feeding mechanism 2 switches a rotation direction of the motor 22*c* from the forward rotation to a reverse rotation and raises the drawing roller 22*a*. When the drawing roller 22*a* is moved to the upper limit position P1, the rotation of the motor 22*c* is stopped. Accordingly, an amount of the wire W necessary for binding the reinforcing bars S by the reinforcing bar binding machine 1A is loosened between the roller 23*a* of the first wire leading portion 23 and the roller 24*a* of the second wire leading portion 24.

As described above, in the binding device 100A, the reinforcing bar binding machine 1A is in a form in which the curl forming portion 5 faces upward, and the opening portion 92 of the wire locking body exposure portion 93 faces upward. Therefore, in the binding device 100A, when the reinforcing bars S abut against the abutting portion 91 by an operation of inserting the reinforcing bars S into the curl forming portion 5 of the reinforcing bar binding machine 1A, the reinforcing bars S and the abutting portion 91 rub against each other, and thus there is a possibility that foreign objects adhering to the reinforcing bars S fall and enter into the wire locking body exposure portion 93 from the opening portion 92.

When the wire W passes between the center hook 70C and the first side hook 70R and between the center hook 70C and the second side hook 70L, which constitute the wire locking body 70, the wire W rubs against the wire locking body 70, and thus there is a possibility that foreign objects such as scrapings inside the wire locking body exposure portion 93 are generated. Further, due to the operation of cutting the wire W by the cutting portion 6, the cut end of the wire W may remain inside the wire locking body exposure portion 93.

Therefore, the reinforcing bar binding machine 1A includes the discharging portion 94 that discharges the foreign objects inside the wire locking body exposure portion 93 to the outside of the main body portion 10. The discharging portion 94 is implemented by providing openings communicating with the wire locking body exposure portion 93 on both side portions of the main body portion 10. Accordingly, the foreign objects inside the wire locking body exposure portion 93 can be discharged from the discharging portion 94 to the outside of the main body portion 10.

In the reinforcing bar binding machine 1A, there is a possibility that foreign objects such as scrapings of the wire W may be generated when the wire W fed in the forward direction rubs against the guide member 53*a*. As described above, in the binding device 100A, since the curl forming portion 5 of the reinforcing bar binding machine 1A faces upward, there is a possibility that foreign objects such as scrapings generated when the wire W rubs against the guide member 53*a* enter the path 55*a* and the movable member movement region between the supporting member 55 and the movable member 56 of the guide member moving mechanism 54.

When foreign objects that enter into the path 55*a* and the movable member movement region 55*b* between the supporting member 55 and the movable member 56 of the guide member moving mechanism 54 accumulate, there is a possibility that the movable member 56 that is moved to the open position cannot be moved to the closed position, and the guide member 53*a* cannot protrude to the path 55*a*. In a state in which the guide member 53*a* does not protrude to the path 55*a*, the wire W cannot be sufficiently curled, and there is a possibility that a feeding failure of the wire W may occur.

Therefore, the reinforcing bar binding machine 1A includes the accumulation suppressing portion 58 that suppresses foreign objects that enter into the path 55*a* and the movable member movement region 55*b* between the supporting member 55 and the movable member 56 of the guide member moving mechanism 54 from accumulating. The accumulation suppressing portion 58 is implemented by providing an opening penetrating the front and back of the supporting member 55 in a part of the site of the supporting member 55 facing the movable member 56. The reinforcing bar binding machine 1A includes the discharging portion 95 that discharges foreign objects in the site where the guide member moving mechanism 54 is provided to the outside of the main body portion 10.

Accordingly, the area of the site where the supporting member 55 and the movable member 56 face each other between the surfaces is reduced, and by the movement of the movable member 56 to the closed position, foreign objects that enter into the path 55*a* and the movable member movement region 55*b* between the supporting member 55 and the movable member 56 can be suppressed from being sandwiched between the movable member 56 and the supporting member 55. Foreign objects that enter into the path 55*a* and the movable member movement region 55*b* between the supporting member 55 and the movable member 56 can be discharged from between the supporting member 55 and the movable member 56 to the outside of the main body portion 10 through the accumulation suppressing portion 58 and the discharging portion 95.

Therefore, even if foreign objects enter the path 55*a* and the movable member movement region 55*b* between the supporting member 55 and the movable member 56 of the guide member moving mechanism 54, the foreign objects are suppressed from accumulating, and an inhibition factor by which the movable member 56 that is moved to the open position cannot be moved to the closed position is eliminated. Therefore, the guide member 53*a* can be moved to a normal position at which the guide member 53*a* protrudes to the path 55*a*, and the guide member 53*a* can exhibit a function of curling the wire W.

Further, the reinforcing bar binding machine 1A includes the discharging portion 31 that mainly discharges foreign objects generated in the wire feeding portion 3 and the wire guide 4 due to rubbing of the wire W fed by the wire feeding portion 3 to the outside of the main body portion 10. Accordingly, foreign objects such as scrapings generated due to rubbing between the wire W and the feeding gears 30 and rubbing between the wire W and the wire guide 4 can be discharged from the discharging portion 31 to the outside of the main body portion 10.

<Modifications of Reinforcing Bar Binding Machine>

Figure 9A:
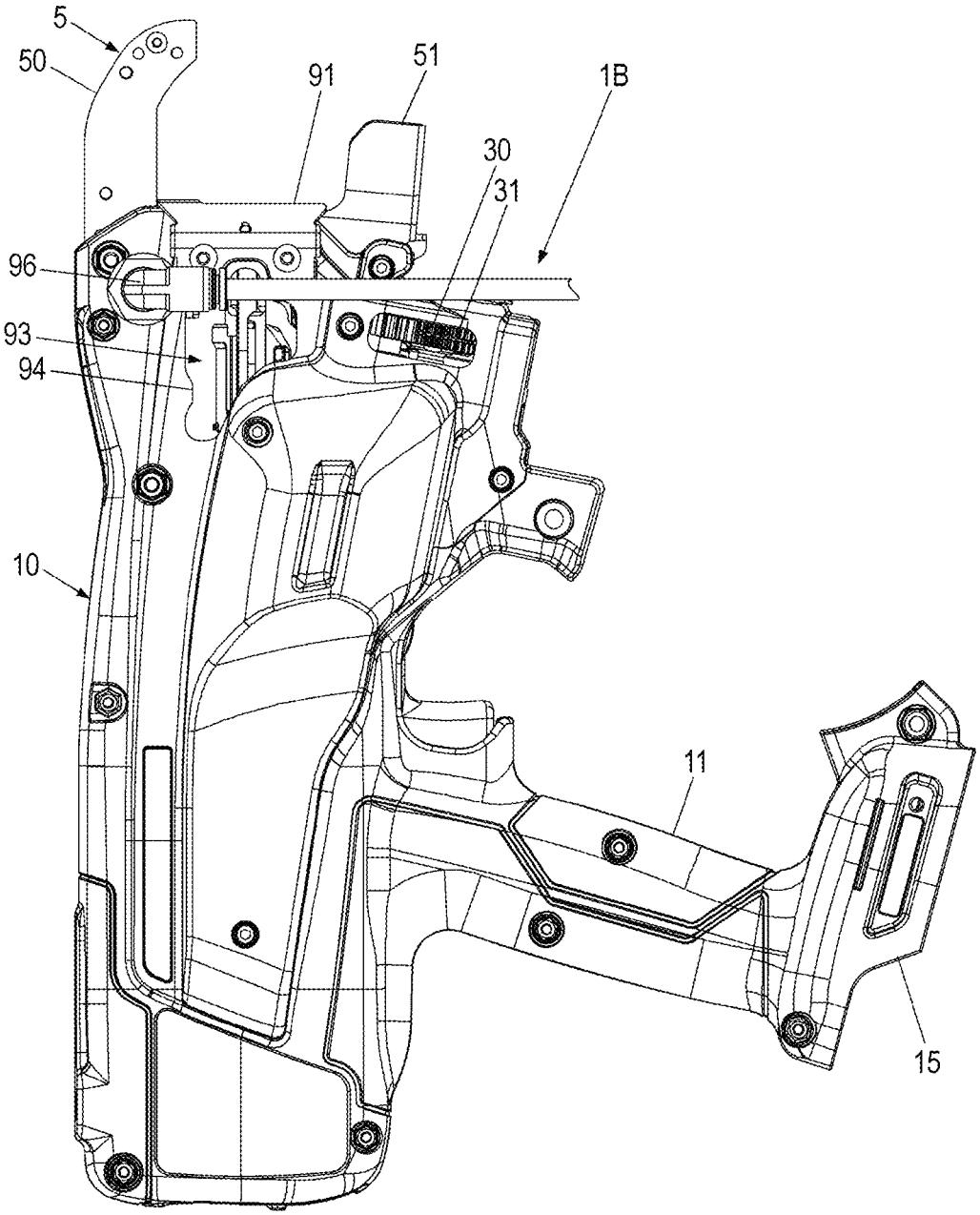
FIG. 9A is a perspective view illustrating another example of the reinforcing bar binding machine according to the present embodiment.
Figure 9B:
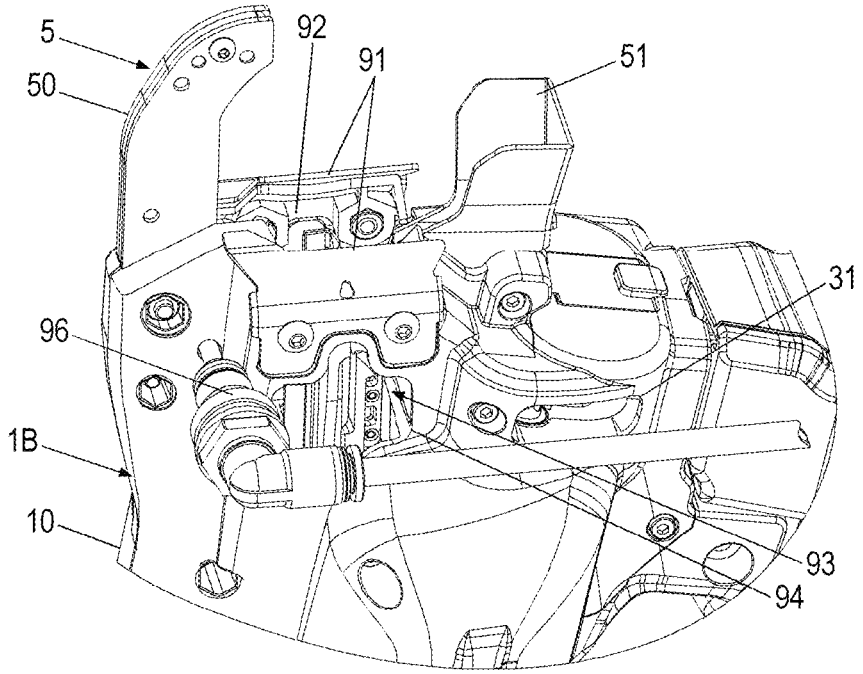
FIG. 9B is a main portion perspective view illustrating the other example of the reinforcing bar binding machine according to the present embodiment.

FIG. 9A is a perspective view illustrating another example of the reinforcing bar binding machine according to the present embodiment, and FIG. 9B is a main portion perspective view illustrating the other example of the reinforcing bar binding machine according to the present embodiment.

A reinforcing bar binding machine 1B includes a gas blowing portion 96 that blows gas to a site where the guide member moving mechanism 54 is provided in the main body portion 10. The gas blowing portion 96 is an example of an accumulation suppressing portion, and a gas outlet (not illustrated) is provided at the site where the guide member moving mechanism 54 is provided. The gas blowing portion 96 is connected to an air compressor that generates compressed air as the gas.

In the reinforcing bar binding machine 1B, when the compressed air is supplied to the gas blowing portion 96, the compressed air is blown out to the site where the guide member moving mechanism 54 is provided in the main body portion 10. Accordingly, foreign objects that enter into the site where the guide member moving mechanism 54 is provided are blown off by a pressure of the air, and the foreign objects are suppressed from accumulating. Therefore, even if foreign objects enter the path 55*a* and the movable member movement region 55*b* between the supporting member 55 and the movable member 56 of the guide member moving mechanism 54, the foreign objects are suppressed from accumulating, and an inhibition factor by which the movable member 56 that is moved to the open position cannot be moved to the closed position is eliminated.

The reinforcing bar binding machine 1B may include a fan that is driven by the motor 80 or a fan that is driven by an independent motor, and may blow the flow of air generated by the fan from the gas blowing portion 96. Before the movable member 56 is moved from the open position to the closed position, the air (the compressed air) may be blown out from the gas blowing portion 96 during the movement of the movable member 56 to the open position.

In the reinforcing bar binding machine 1B, the gas blowing portion may function as a gas suction portion that sucks the gas in the site where the guide member moving mechanism 54 is provided in the main body portion 10. In the reinforcing bar binding machine 1B, by sucking air in the site where the guide member moving mechanism 54 is provided in the main body portion 10 from the gas suction portion, foreign objects that enter into the site where the guide member moving mechanism 54 is provided are sucked and the foreign objects are suppressed from accumulating. Further, the reinforcing bar binding machine 1B may be applied to the binding device 100A.

Figure 10A:
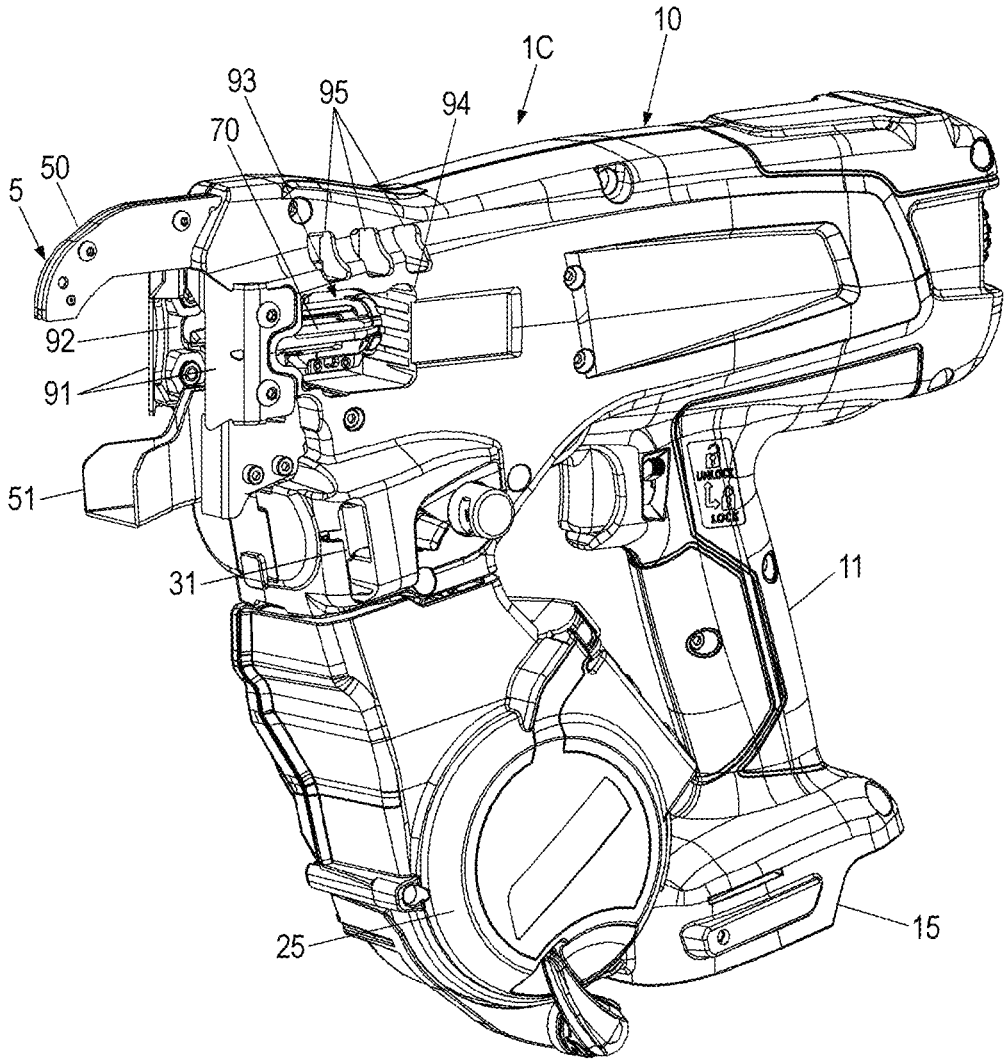
FIG. 10A is a perspective view illustrating another example of the reinforcing bar binding machine according to the present embodiment.
Figure 10B:
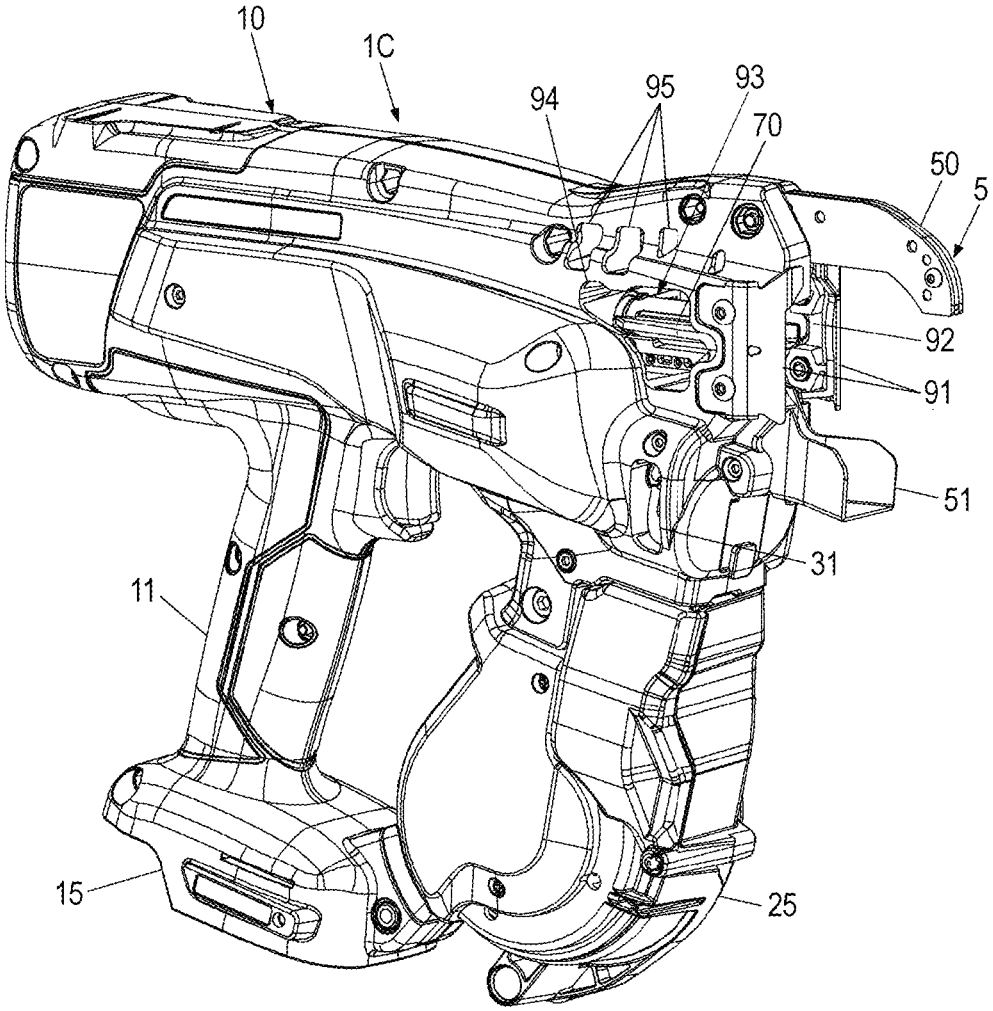
FIG. 10B is a perspective view illustrating the other example of the reinforcing bar binding machine according to the present embodiment.

FIGS. 10A and 10B are perspective views each illustrating another example of the reinforcing bar binding machine according to the present embodiment. When a reinforcing bar binding machine 1C is used by being held by a hand of a worker, the reinforcing bar binding machine 1C includes a reel accommodating portion 25 in which a reel (not illustrated) around which the wire W is wound in a manner of being capable of being drawn out is accommodated. The reel around which the wire W is wound in a manner of being capable of being drawn out is rotatably and detachably accommodated in the reel accommodating portion 25.

In a configuration in which the reinforcing bar binding machine 1C binds the reinforcing bars S with two wires W, the two wires W are wound around a hub portion of the reel, and the two wires W can be drawn out simultaneously.

<Modifications of Guide Member Moving Mechanism>

Figure 11A:
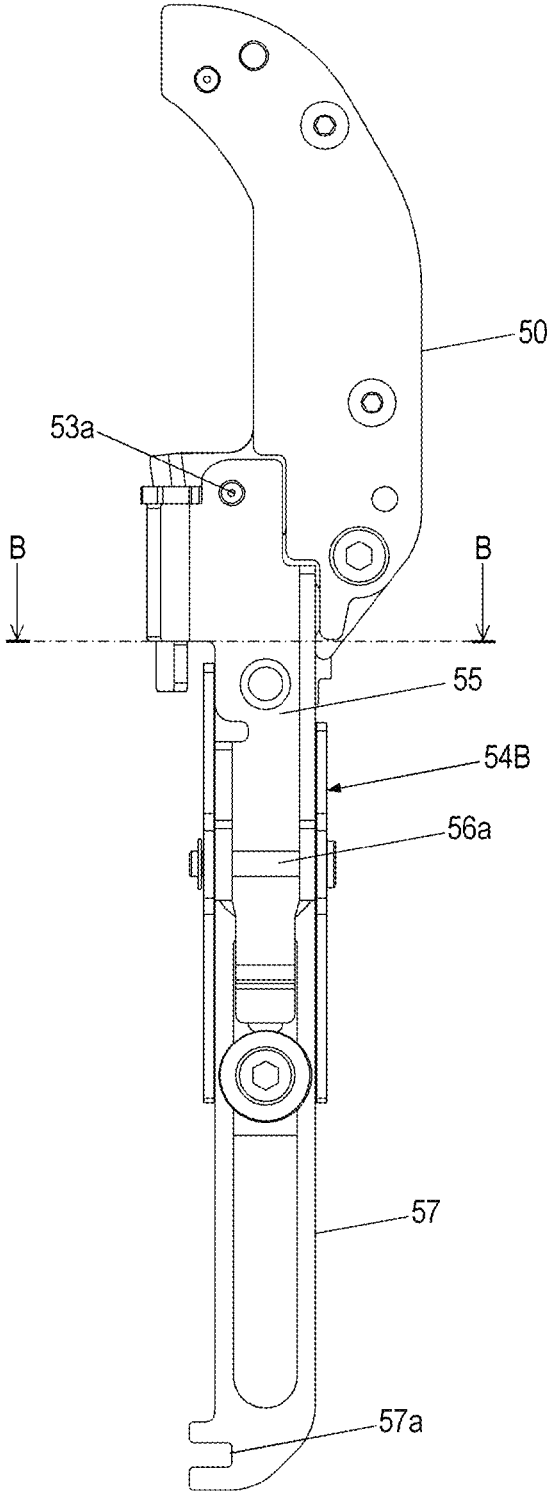
FIG. 11A is a side view illustrating another example of the guide member moving mechanism.
Figure 11B:
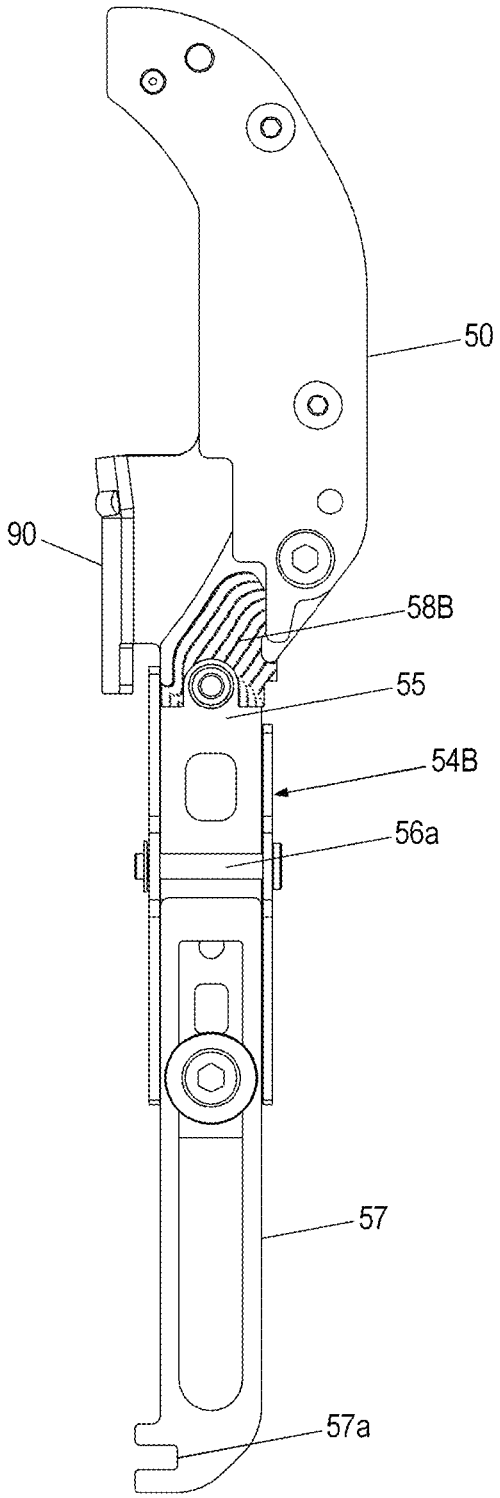
FIG. 11B is a side view illustrating the other example of the guide member moving mechanism with some parts removed.
Figure 11C:
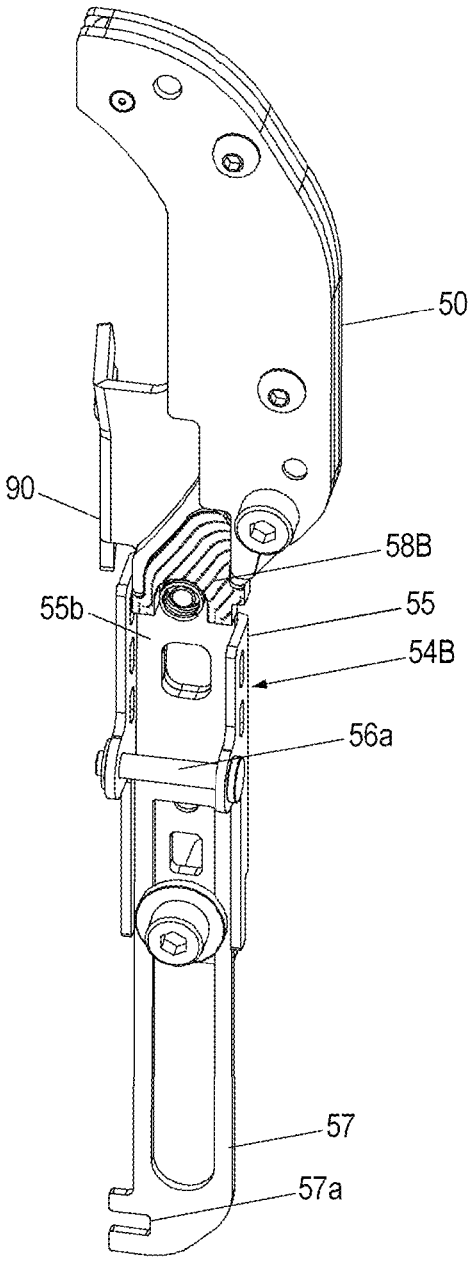
FIG. 11C is a perspective view illustrating the other example of the guide member moving mechanism with some parts removed.
Figure 11D:
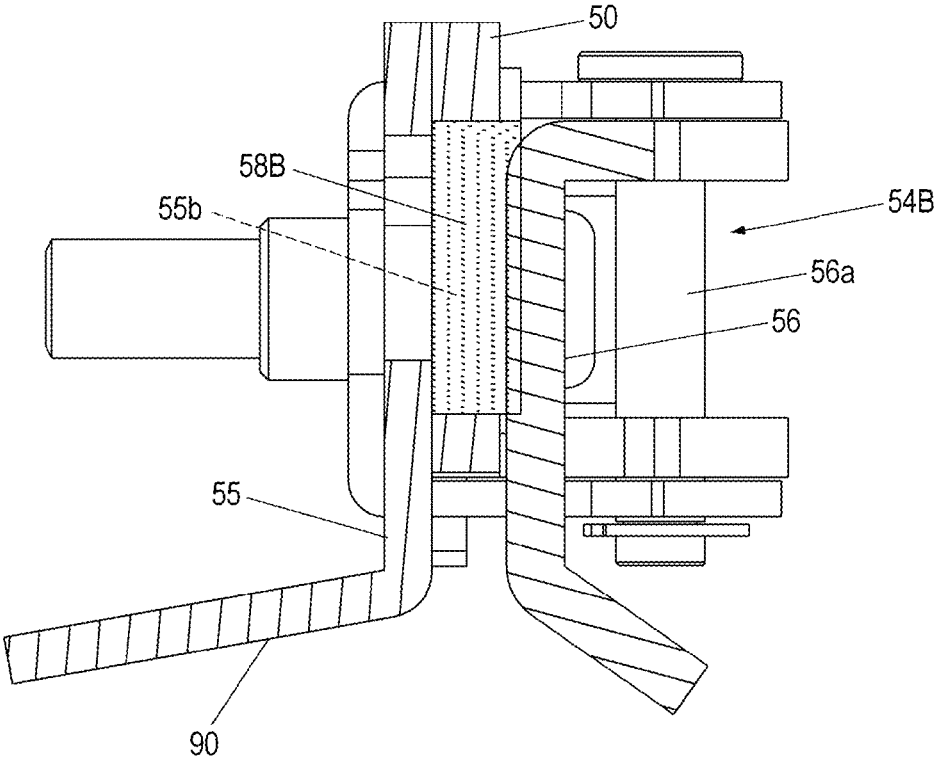
FIG. 11D is a front cross-sectional view illustrating the other example of the guide member moving mechanism.

FIG. 11A is a side view illustrating another example of the guide member moving mechanism, FIG. 11B is a side view illustrating the other example of the guide member moving mechanism with some parts removed, FIG. 11C is a perspective view illustrating the other example of the guide member moving mechanism with some parts removed, and FIG. 11D is a front cross-sectional view illustrating the other example of the guide member moving mechanism. FIG. 11D is a simplified cross-sectional view taken along a line B-B in FIG. 11A.

Hereinafter, a configuration of a guide member moving mechanism 54B and a configuration for suppressing foreign objects that enter into the guide member moving mechanism 54B will be described with reference to the drawings.

The guide member moving mechanism 54B includes the supporting member 55 fixed to the main body portion 10, and the movable member 56 that is movably supported by the supporting member 55 by, for example, a rotational operation and that moves the guide member 53*a*. A configuration in which the movable member 56 is moved between a closed position and an open position by a rotational operation with the shaft 56*a* as a fulcrum with respect to the supporting member 55 and a configuration in which the movable member 56 is actuated by actuating member 57 are the same as the configurations described with reference to FIGS. 3A to 3C and 4A to 4C.

The guide member moving mechanism 54B includes an entry suppressing portion 58B that suppresses foreign objects from entering into the movable member movement region 55*b* between the supporting member 55 and the movable member 56. The entry suppressing portion 58B is implemented by providing an elastic body having a shape that closes an opening of the movable member movement region 55*b* on a side where the curl guide 50 is provided, at a site facing the movable member 56 on an end portion on a side where the curl guide 50 is fixed in the supporting member 55.

As described above, in the binding device 100A, the reinforcing bar binding machine 1A is used in a form in which the curl forming portion 5 faces upward. Therefore, since the opening of the movable member movement region 55*b* on the side where the curl guide 50 is provided faces upward, foreign objects falling due to gravity enter easily.

In the guide member moving mechanism 54B, when the movable member 56 is moved to the closed position, the entry suppressing portion 58B is pressed and elastically deformed between the supporting member 55 and the movable member 56, thereby closing the opening of the movable member movement region 55*b* on the side where the curl guide 50 is provided. Accordingly, the foreign objects are suppressed from entering into the movable member movement region 55*b* between the supporting member 55 and the movable member 56.

Figure 12A:
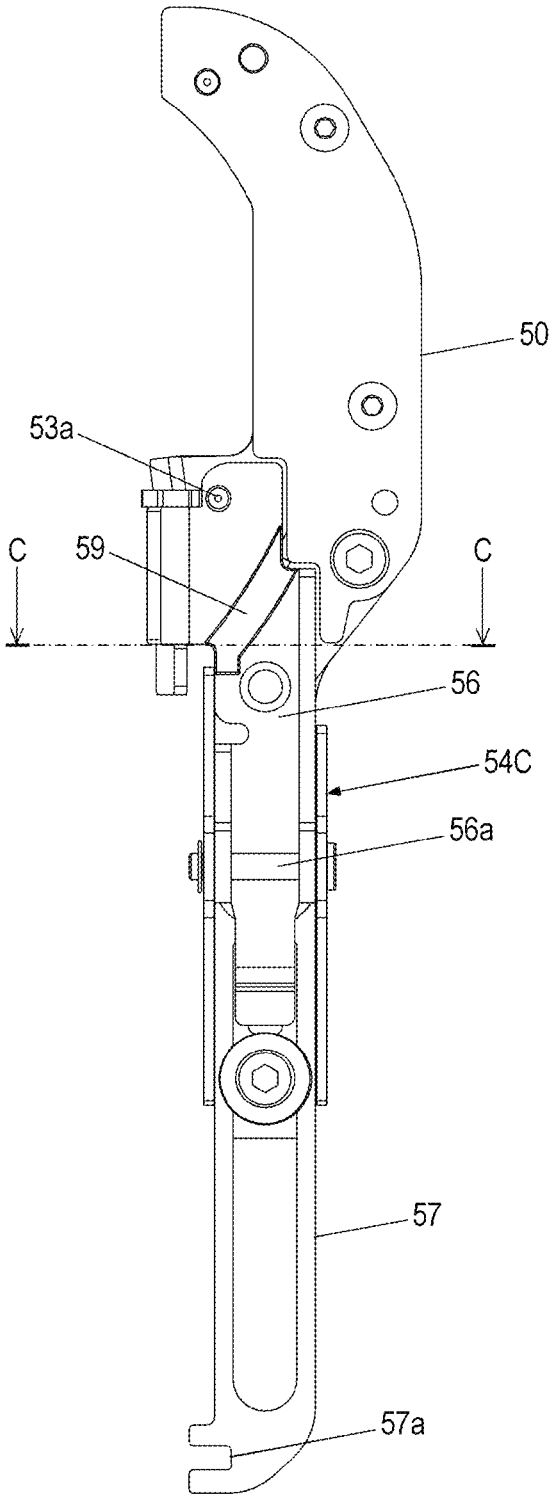
FIG. 12A is a side view illustrating another example of the guide member moving mechanism.
Figure 12B:
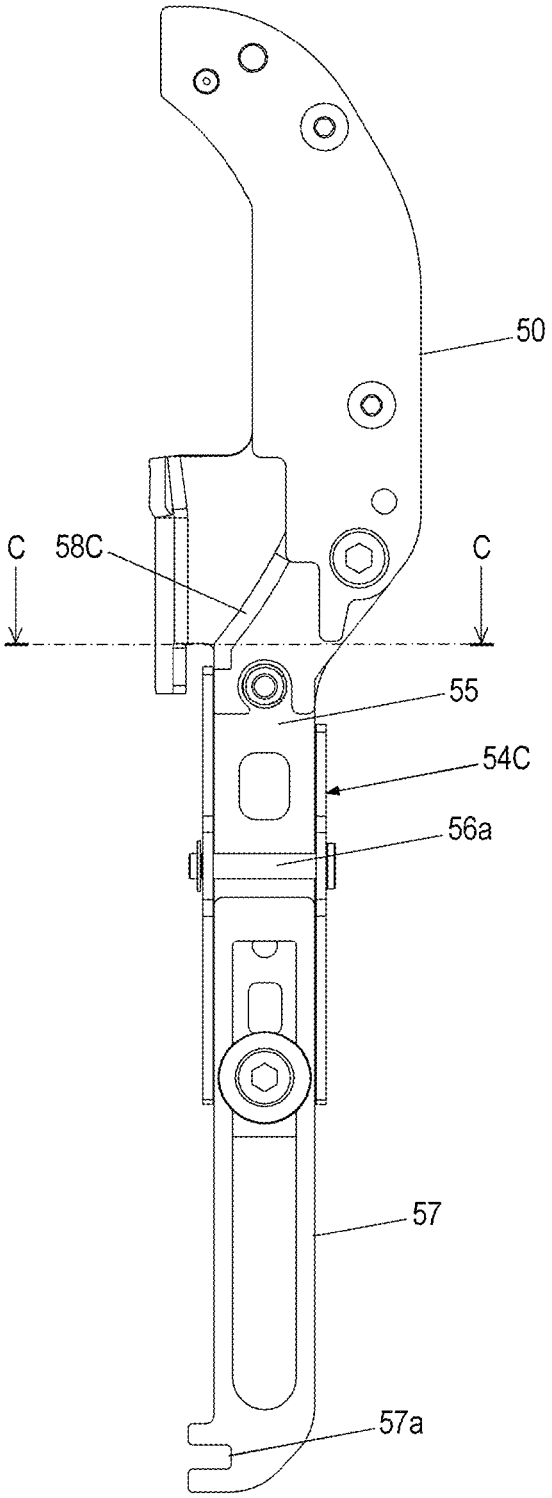
FIG. 12B is a side view illustrating the other example of the guide member moving mechanism with some parts removed.
Figure 12C:
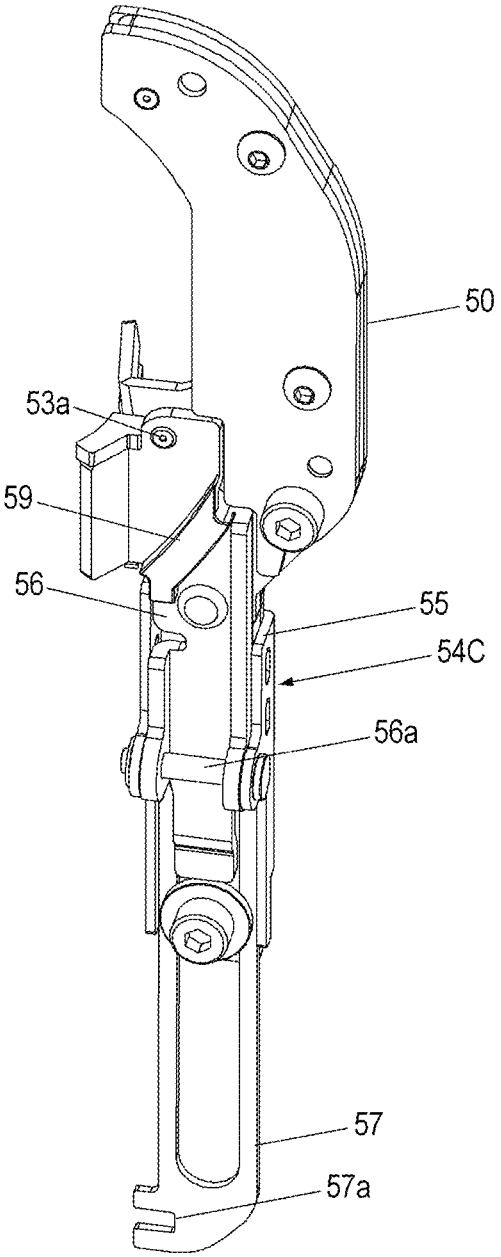
FIG. 12C is a perspective view illustrating the other example of the guide member moving mechanism.
Figure 12D:
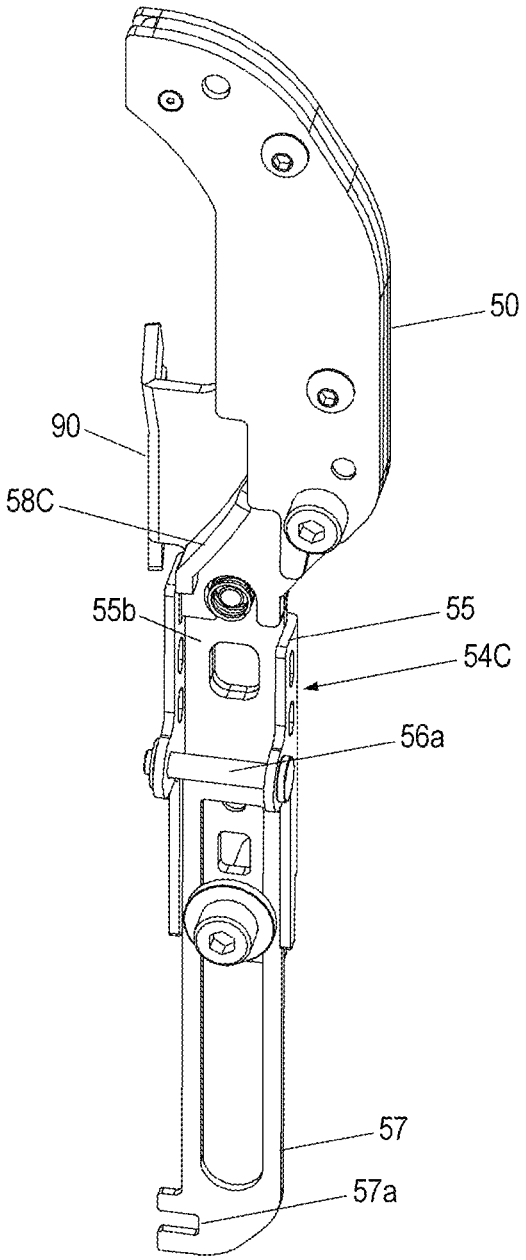
FIG. 12D is a perspective view illustrating the other example of the guide member moving mechanism with some parts removed.
Figure 12E:
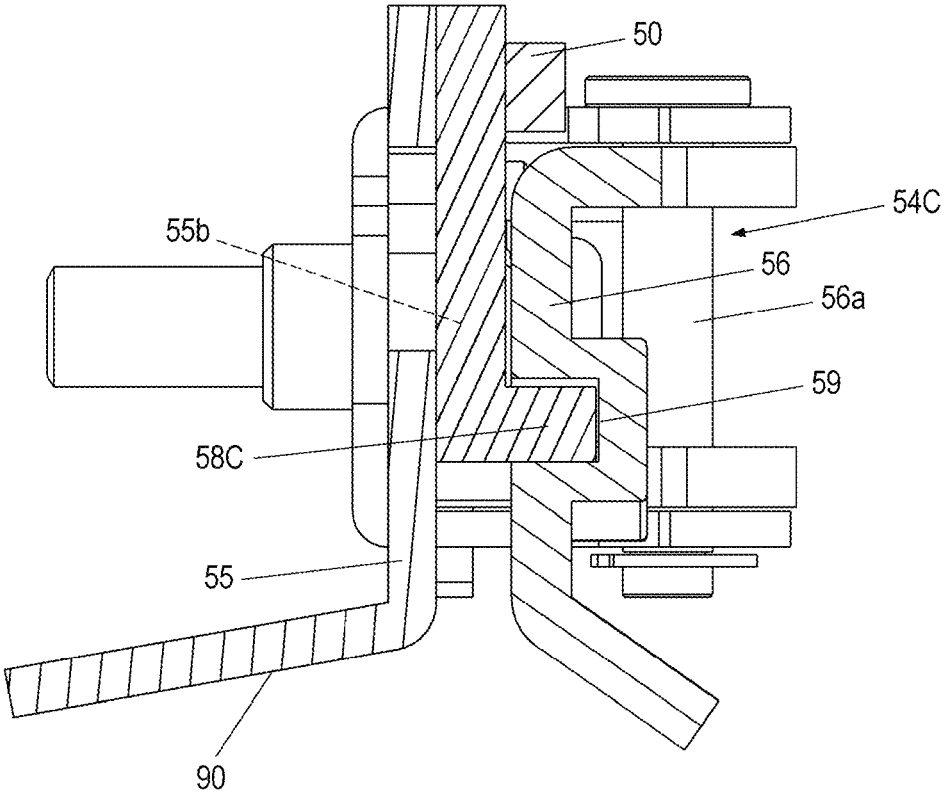
FIG. 12E is a front cross-sectional view illustrating the other example of the guide member moving mechanism.
Figure 12F:
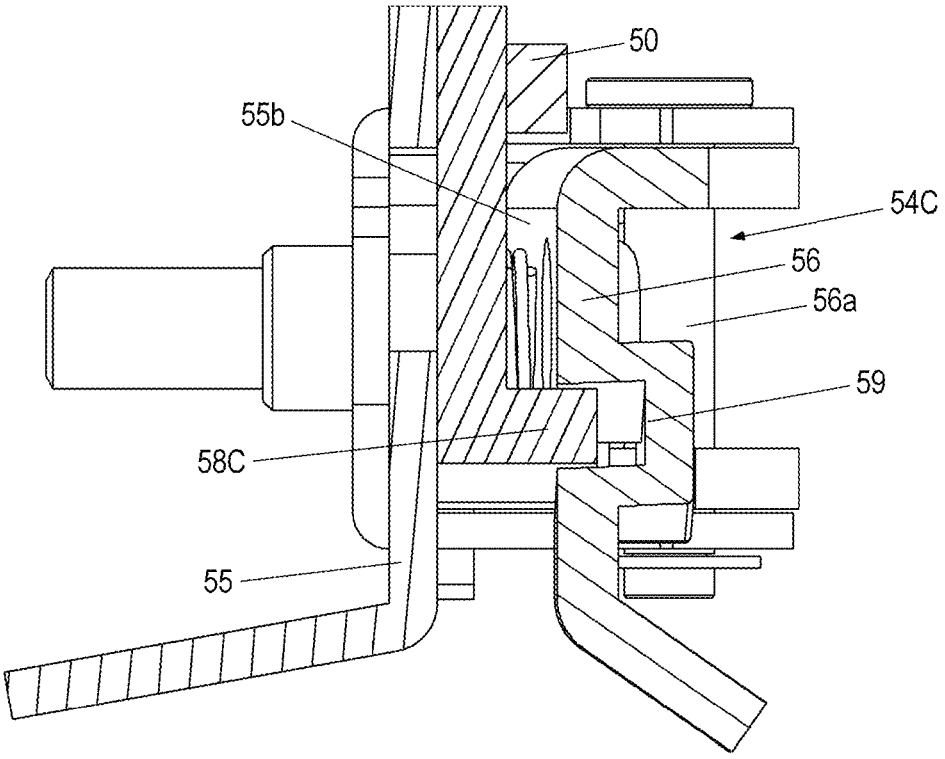
FIG. 12F is a front cross-sectional view illustrating the other example of the guide member moving mechanism.

FIG. 12A is a side view illustrating another example of the guide member moving mechanism, and FIG. 12B is a side view illustrating the other example of the guide member moving mechanism with some parts removed. FIG. 12C is a perspective view illustrating the other example of the guide member moving mechanism, and FIG. 12D is a perspective view illustrating the other example of the guide member moving mechanism with some parts removed. Further, FIGS. 12E and 12F are front cross-sectional views each illustrating the other example of the guide member moving mechanism. FIGS. 12E and 12F are simplified cross-sectional views each taken along a line C-C in FIG. 12A.

Hereinafter, a configuration of a guide member moving mechanism 54C and a configuration for suppressing foreign objects that enter into the guide member moving mechanism 54C will be described with reference to the drawings.

The guide member moving mechanism 54C includes the supporting member 55 fixed to the main body portion 10, and the movable member 56 that is movably supported by the supporting member 55 by, for example, a rotational operation and that moves the guide member 53*a*. A configuration in which the movable member 56 is moved between a closed position and an open position by a rotational operation with the shaft 56*a* as a fulcrum with respect to the supporting member 55 and a configuration in which the movable member 56 is actuated by actuating member 57 are the same as the configurations described with reference to FIGS. 3A to 3C and 4A to 4C.

The guide member moving mechanism 54C includes an entry suppressing portion 58C that suppresses foreign objects from entering into the movable member movement region 55*b* between the supporting member 55 and the movable member 56. The entry suppressing portion 58C is implemented by providing a convex portion having a shape that closes an opening of the movable member movement region 55*b* on a side where the curl guide 50 is provided, at a site facing the movable member 56 on an end portion on a side where the curl guide 50 is fixed in the supporting member 55.

The guide member moving mechanism 54C includes a groove portion 59 into which the entry suppressing portion 58C enters. The groove portion 59 is implemented by providing, on a site of the movable member 56 facing the entry suppressing portion 58C, a concave portion having a shape into which the entry suppressing portion 58C enters when the movable member 56 is moved to the closed position.

In the guide member moving mechanism 54C, when the movable member 56 is moved to the closed position, the entry suppressing portion 58C enters into the groove portion 59, thereby closing the opening of the movable member movement region 55*b* on the side where the curl guide 50 is provided. Accordingly, the foreign objects are suppressed from entering into the movable member movement region 55*b* between the supporting member 55 and the movable member 56.

The entry suppressing portion 58B or the entry suppressing portion 58C may be provided in the guide member moving mechanism 54 described with reference to FIGS. 3A to 3C, 4A to 4C, and 5. A reinforcing bar binding machine including the guide member moving mechanism 54B provided with the entry suppressing portion 58B and a reinforcing bar binding machine including the guide member moving mechanism 54C provided with the entry suppressing portion 58C may be applied to the binding device 100A.

According to the present invention, there is provided a binding machine, including: a wire feeding portion configured to feed a wire; a guide portion constituting a part of a path through which the wire fed by the wire feeding portion is to pass; a displacement portion configured to move the guide portion between a first position constituting the path and a second position retracted from the path; a driving portion configured to drive the displacement portion; and an accumulation suppressing portion configured to suppress a foreign object from accumulating in a region formed along a moving direction of the displacement portion that is configured to move between the first position and the second position.

According to the present invention, foreign objects are suppressed from accumulating in a region formed along a moving direction of a displacement portion that moves the guide portion, and a factor that inhibits movement of the displacement portion is eliminated.

According to the present invention, there is provided a binding machine, including: a wire feeding portion configured to feed a wire; a guide portion constituting a part of a path through which the wire fed by the wire feeding portion is to pass; a displacement portion configured to move the guide portion between a first position constituting the path and a second position retracted from the path; a driving portion configured to drive the displacement portion; and an entry suppressing portion configured to suppress a foreign object from entering into a region formed along a moving direction of the displacement portion that is configured to move between the first position and the second position.

According to the present invention, foreign objects are suppressed from entering into the region formed along the moving direction of the displacement portion that moves the guide portion, and a factor that inhibits the movement of the displacement portion is eliminated.

According to the present invention, there is provided a binding device, including: a binding machine configured to bind an object to be bound with a wire. The binding machine includes a wire feeding portion configured to feed the wire, a guide portion constituting a part of a path through which the wire fed by the wire feeding portion is to pass, a displacement portion configured to move the guide portion between a first position constituting the path and a second position retracted from the path, a driving portion configured to drive the displacement portion, and an accumulation suppressing portion configured to suppress a foreign object from accumulating in a region formed along a moving direction of the displacement portion that is configured to move between the first position and the second position.

According to the present invention, in the binding machine used in the binding device, foreign objects are suppressed from accumulating in the region formed along the moving direction of the displacement portion that moves the guide portion, and the factor that inhibits the movement of the displacement portion is eliminated.

According to the present invention, there is provided a binding device, including: a binding machine configured to bind an object to be bound with a wire. The binding machine includes a wire feeding portion configured to feed the wire, a guide portion constituting a part of a path through which the wire fed by the wire feeding portion is to pass, a displacement portion configured to move the guide portion between a first position constituting the path and a second position retracted from the path, a driving portion configured to drive the displacement portion, and an entry suppressing portion configured to suppress a foreign object from entering into a region formed along a moving direction of the displacement portion that is configured to move between the first position and the second position.

According to the present invention, in the binding machine used in the binding device, foreign objects are suppressed from entering into the region formed along the moving direction of the displacement portion that moves the guide portion, and the factor that inhibits the movement of the displacement portion is eliminated.

According to the present invention, since it is possible to suppress foreign objects that inhibit the movement of the displacement portion from accumulating, the guide portion can be moved to a normal position. According to the present invention, since it is possible to suppress foreign objects that inhibit the movement of the displacement portion from entering, the guide portion can be moved to a normal position.

What is claimed is:

1. A binding machine, comprising:

a main body portion covered with an exterior having a predetermined shape;

a plurality of feeding gears and a feeding motor configured to feed a wire;

a guide portion constituting a part of a path through which the wire, which has been fed, is to pass;

a movable member included in the main body portion and configured to move the guide portion between a first position constituting the path and a second position retracted from the path;

a supporting member configured to movably support the movable member and forming the path between the movable member and the supporting member at the first position; and a driving motor and a speed reducer configured to drive the movable member, wherein the movable member or the supporting member includes an opening configured to suppress a foreign object from accumulating between the movable member and the supporting member, the opening is connected to a region between the movable member and the supporting member, and the exterior includes a discharging portion connected to the opening and through which the foreign object is to be discharged to an outside of the main body portion.

2. The binding machine according to claim 1, wherein the opening of the supporting member is disposed at a position facing the movable member.

3. The binding machine according to claim 1, further comprising:

an elastic body configured to suppress the foreign object from entering into a region between the movable member and the supporting member.

4. The binding machine according to claim 1, wherein when the movable member is moved to the first position, the guide portion constitutes a path for winding the wire fed by the feeding gears and the feeding motor around an object to be bound.

5. A binding machine, comprising:

a plurality of feeding gears and a feeding motor configured to feed a wire;

a guide portion constituting a part of a path through which the wire, fed by the feeding gears and the feeding motor, is to pass;

a movable member including a biasing member configured to move the guide portion between a first position constituting the path and a second position retracted from the path;

a supporting member configured to movably support the movable member and forming the path between the movable member and the supporting member at the first position;

a driving motor and a speed reducer configured to drive the movable member, wherein the movable member or the supporting member includes an elastic body configured to suppress a foreign object from entering between the movable member and the supporting member by being pressed and elastically deformed.

6. The binding machine according to claim 5, wherein when the movable member is moved to the first position, the elastic body closes a region between the movable member and the supporting member.

7. The binding machine according to claim 5, wherein the elastic body is provided at a site facing the movable member.

8. A binding device, comprising:

a binding machine configured to bind an object to be bound with a wire, wherein the binding machine is the binding machine according to claim 5.

* * * * *